US005623826A

United States Patent [19]

Ohtsuka et al.

[11] Patent Number: 5,623,826

[45] Date of Patent: Apr. 29, 1997

[54] COMBUSTOR HAVING A PREMIX CHAMBER WITH A BLADE-LIKE STRUCTURAL MEMBER AND METHOD OF OPERATING THE COMBUSTOR

[75] Inventors: Masaya Ohtsuka; Shin-ichi Inage, both of Hitachi, Japan

[73] Assignee: Hitachi, Ltd., Tokyo, Japan

[21] Appl. No.: 281,099

[22] Filed: Jul. 27, 1994

[30] Foreign Application Priority Data

Jul. 30, 1993 [JP] Japan ..... 5-189882

[51] Int. Cl.[6] ..... F23K 3/00

[52] U.S. Cl. ..... 60/737; 60/747; 60/748

[58] Field of Search ..... 60/737, 738, 746, 60/747, 748, 39.37

[56] References Cited

U.S. PATENT DOCUMENTS

| | | | |
|---|---|---|---|
| 2,558,816 | 7/1951 | Bruynes | 138/37 |
| 2,607,191 | 8/1952 | Lee | 60/35.6 |
| 5,121,597 | 6/1992 | Urushidani et al. | 60/747 |
| 5,239,831 | 8/1993 | Kuroda et al. | 60/737 |
| 5,361,586 | 11/1994 | McWhirter et al. | 60/737 |

FOREIGN PATENT DOCUMENTS

| | | |
|---|---|---|
| 1-203809 | 8/1989 | Japan . |
| 2-275221 | 11/1990 | Japan . |
| 4-103906 | 4/1992 | Japan . |

*Primary Examiner*—Charles G. Freay

*Attorney, Agent, or Firm*—Fay, Sharpe, Beall, Fagan, Minnich & McKee

[57] ABSTRACT

A combustor includes a pilot burner provided at a center portion thereof, and a premixer surrounding the pilot burner. The premixer has a plurality of premix chambers separated from one another in a peripheral direction. Each of the premix chambers includes a fuel injection nozzle provided at an inlet portion thereof, and a blade-like structural member disposed downstream of the fuel injection nozzle. Fuel and air, supplied from an inlet of the premixer, jointly form a premixture, and a Lanchester vortex is formed rearwardly of the blade-like structural member. The Lanchester vortex forms circulating flows at the outlet of the premixer, and also forms a main stream outside these circulating flows.

12 Claims, 3 Drawing Sheets

COMBUSTOR HAVING A PREMIX CHAMBER WITH A BLADE-LIKE STRUCTURAL MEMBER AND METHOD OF OPERATING THE COMBUSTOR

BACKGROUND OF THE INVENTION

This invention relates to a combustor with a premixer, and more particularly to a combustor suited for use in a gas turbine, and also relates to a method of operating such a combustor.

In a combustor, for example, for a gas turbine, in order to reduce nitrogen oxides (hereinafter referred to as "NOx"), a premix combustion method is used in which fuel and air are premixed, and then this premixture is burned. This premix combustion method is superior to a diffusion combustion method, in which the combustion is effected by supplying fuel and air separately, in that the fuel concentration is kept low to thereby prevent localized high-temperature regions from being produced, thus reducing an amount of production of NOx in exhaust gas.

However, in the premix combustion method in which any localized high-temperature region is prevented from being produced, a flame can become unstable because of the absence of high-temperature regions, and is liable to be blown out. As a result, a back fire is liable to occur. The fuel-air premixture is not sufficiently mixed spatially uniformly, and therefore there has been encountered a problem that the effect of reducing NOx is not satisfactory. In order to overcome this, there have heretofore been made various proposals.

For example, Japanese Patent Unexamined Publication Nos. 1-203809 and 2-275221 disclose a construction in which a premixer is formed into a conical shape, and fuel is injected axially from a nozzle mounted on an apex of the conical premixer. Air is introduced in a direction tangential to the side wall of the conical premixer to produce a rotating or swirling stream flowing circumferentially within the premixer, thereby making the fuel-air premixture uniform. Also, an axial circulating flow is formed at an outlet of the premixer, thereby stabilizing a flame. Japanese Patent Unexamined Publication No. 4-103906 discloses a construction in which a flame stabilizer is provided at an outlet of a premixer, and an axial circulating flow is produced downstream of the flame stabilizer to thereby stabilize a flame. There is also known a construction in which a whirl flow is applied to a fuel-air premixture to produce a reverse flow in the vicinity of the center of the swirl, and hot burnt matters are held by this reverse flow, and by using this as an ignition source, flame is stabilized.

A combustor is required to have a compact size, and it is necessary to maintain a flame stably over a wide range from start-up to a rated operation. In the type of gas turbine combustor in which a plurality of combustors are connected together by flame propagation pipes, it is essential that each combustor should be positively ignited at the time of start-up and that the flame should positively propagate from the start-up combustor to other combustors.

However, in the construction disclosed in the above Japanese Patent Unexamined Publication Nos. 1-203809 and 2-275221 in which the premixer is formed into a conical shape, in order to sufficiently mix the fuel-air premixture within the conical premixer and also to produce a circulating flow at the outlet of the premixer, the premixer must have a sufficiently long axial length. Therefore, the premixer cannot be of a small size. Moreover, when the velocity of flow of the fuel-air premixture decreases, the circulating flow at the outlet cannot be formed stably, so that the flame becomes unstable. Therefore, this construction cannot be applied to continuous load operation of the gas turbine. Furthermore, pressure losses at an air-inlet port and at an apex of the conical premixer are large, and therefore the efficiency of the combustor is low.

In the construction disclosed in the above Japanese Patent Unexamined Publication No. 4-103906 in which the flame stabilizer is provided at the outlet of the premixer, the flame stabilizer is exposed to hot combustion gas, and therefore it is essential to cool the flame stabilizer in order to prevent burning damage. This requires a complicated cooling structure, and the premixer cannot be of a small size.

In the type of construction in which the swirl flow is applied to the fuel-air mixture, a stagnant region where the flow velocity is zero is produced in the vicinity of the center of the reverse flow region produced by the swirling effect, and therefore the flame becomes unstable, and the blowing-out of the flame and combustion vibrations are encountered.

Furthermore, since any particular consideration is given to the mixing of air and fuel within the premixer, a satisfactory uniformity of the fuel-air premixture is not obtained, and therefore the NOx-reducing effect is low. Furthermore, in the above-mentioned conventional construction, the positive ignition of each combustor at the time of start-up of the gas turbine combustor, in which the plurality of combustors are connected together by the flame propagation pipes, as well as the positive flame propagation to other combustors at the time of increase of the output, is not taken into consideration at all.

SUMMARY OF THE INVENTION

In view of the above-mentioned problems, it is a first object of this invention to provide a combustor which is small in size, has a flame stabilizing ability, can prevent the blowing-out of flame, and can reduce an amount of production of NOx, and also to provide a method of operating such a combustor.

A second object of the invention is to provide a gas turbine combustor capable of continuous load operation, and also to provide a method of operating such a gas turbine combustor.

A third object of the invention is to provide a gas turbine combustor which is excellent in flame propagating property.

The above objects are achieved by the present invention having the following features.

In the following description, if not specifically meant otherwise, "the direction of a main stream of a premixture" means a direction of a centerline connecting the centers of an inlet and outlet of a premixer.

The above first object is achieved by a construction in which a structural member for producing a vortex having an axis of rotation thereof extending in a direction of a main stream of a premixture is provided within a premixer, or a construction in which a structural member, having an angle of elevation with respect to the direction of the main stream of the premixture, is provided within the premixer, and the structural member has a portion which is not contacted with an inner surface of the premixer. Alternatively, the first object is achieved by a construction in which a structural member for producing a turbulence in a direction of the main stream of the premixture is provided within the premixer. Preferably, means for producing a turbulence is provided on the above structural member, or a plurality of vortex-producing means are provided on the structural member, or a plurality of structural members mentioned above are provided. Preferably, the above elevation angle is in the range of 10°–20°.

The first object is also achieved by a construction in which a plurality of structural members each for producing a vortex having an axis of rotation thereof extending in a direction of a main stream of a premixture are provided within a premixer, and the vortexes produced downstream of the plurality of structural members are combined together.

The first object is also achieved by a construction in which a structural member for producing a vortex having an axis of rotation thereof extending in a direction of a main stream of a premixture is provided within a premixer, and pressure difference control means for increasing the difference in pressure between the center of the vortex and a peripheral portion thereof is provided within the premixer. Preferably, pressure control means for increasing the pressure at the center of the vortex is provided downstream of the pressure difference control means, or pressure control means for increasing the pressure at the center of the vortex is provided at an outlet portion of the premixer. Preferably, a constricted flow passage is provided as the pressure control means, or an enlarged flow passage is provided as the pressure control means. Preferably, the pressure control means decreases a pressure difference between the center and peripheral portion of the vortex.

The first object is also achieved by a construction in which a premixer contains a structural member for producing a vortex having an axis of rotation thereof extending in a direction of a main stream of a premixture, and flow velocity control means for increasing a velocity of flow of a peripheral portion of the vortex. Preferably, the flow velocity control means is provided at an outlet portion of the premixer. Preferably, a constricted flow passage is provided as the flow velocity control means.

In order to achieve the first object, preferably, the premixer is formed into a cylindrical shape.

In order to achieve the first object, preferably, fuel is supplied from the structural member provided within the premixer.

The first object is also achieved by a construction in which a premixer contains a structural member for producing a vortex having an axis of rotation thereof extending in a direction of a main stream of a premixture, and circulating flows are formed at a center portion of an outlet of the premixer while a main stream is formed outside the circulating flows.

The first object is also achieved by a construction in which a diffusion combustion flame is formed upstream of a premixer, and a premixture combustion flame is formed downstream of the diffusion combustion flame.

The first object is also achieved by a construction in which there is provided means for producing a vortex, having an axis of rotation thereof extending in a direction of a main stream of a premixture, within a premixer, thereby mixing the premixture. Preferably, there is provided means by which a flow rate in the direction of the main stream in the premixer is not less than a half of the total flow rate, and the remaining flow except in the main stream direction produces a flow, swirling about an axis in the main stream direction, within the premixer, thereby mixing the premixture. Preferably, the vortex produced by the above means is produced locally within the premixer. Here, the term "locally" does not mean "entirely" within the premixer, but means "partially". The effect can be further enhanced by producing a plurality of vortexes within the premixer.

The first object is also achieved by an operation method in which after a premixture is mixed using a vortex having an axis of rotation thereof extending in a direction of a main stream of the premixture, the premixture is burned. Preferably, a plurality of vortexes are used to make the directions of rotation of any two adjacent ones of the vortexes opposite to each other.

The first object is also achieved by a construction in which means for forming a premixture into a swirl flow swirling in a peripheral direction of a premixer is provided at an outlet portion of the premixer, said means comprising a fuel injection portion provided at a center portion, a first swirl vane member provided around the fuel injection portion, and a second swirl vane member provided around the first swirl vane member.

The first object is also achieved by a construction in which means for forming a premixture into a swirl flow swirling in a peripheral direction of a premixer is provided at an outlet portion of the premixer, and an intensity of the swirl, representing a ratio of a peripheral flow velocity of the premixture to an axial flow velocity, is greater at a region near to the axis of the swirl flow than at an outer peripheral portion of the swirl flow.

Preferably, in order to achieve the first object, there is provided means for swirling a premixture in a peripheral direction, and this swirling means is such that the intensity of the swirl, representing the ratio of a peripheral flow velocity of the premixture to an axial flow velocity, is decreasing progressively away from a swirl axis.

Preferably, in order to achieve the first object, there is provided a construction which comprises first means for swirling a premixture in a peripheral direction, and second means mounted around the first means for swirling the premixture in the same peripheral direction as the peripheral direction in which the premixture is swirled by the first means, the first and second means being provided at an outlet portion of the premixer. The intensity of swirling of a swirl flow, produced by the first means and representing the ratio of a peripheral flow velocity of the swirl flow to an axial flow velocity, is greater than the intensity of swirling of a swirl flow produced by the second means. Preferably, the intensity of swirling of the swirl flow, produced in the vicinity of the swirl axis by the second means and representing the ratio of the peripheral flow velocity of the swirl flow to the axial flow velocity, is greater than the intensity of the swirl disposed around the swirl flow.

The first and second objects are achieved by a construction in which a pilot burner for injecting air and fuel separately to effect diffusion combustion is provided at a center portion of a combustor, and a plurality of premixers are peripherally arranged in surrounding relation to the pilot burner, and each of the premixers contains a structural member for producing a vortex having an axis of rotation thereof extending in a direction of a main stream of a premixture.

The first and second objects are also achieved by a construction in which a pilot burner for injecting air and fuel separately to effect diffusion combustion is provided at a center portion of a combustor, and a plurality of premixers are peripherally arranged in surrounding relation to the pilot burner, and each of the premixers contains a structural member for producing a vortex having an axis of rotation thereof extending in a direction of a main stream of a premixture, and the directions of rotation of the vortexes, discharged respectively from any two adjacent ones of the premixers, are opposite to each other. Preferably, the direction of rotation of the vortex, discharged from at least one of the premixers, is opposite to the direction of rotation of the vortexes discharged from the other premixers, or the directions of rotation of the vortexes, discharged respectively from the peripherally and radially adjacent premixers, are opposite to each other. Preferably, the combustor comprises a plurality of first premixers arranged peripherally in surrounding relation to the pilot burner, and a plurality of second premixers peripherally arranged downstream of the first premixers.

The first and second objects are also achieved by a construction in which means for producing a whirl flow of the air in a peripheral direction of a premixer is provided within the premixer, and a structural member for producing a vortex having an axis of rotation thereof extending in a direction of a main stream of a premixture is provided within the premixer.

The first and second objects are also achieved by a construction in which means for producing a swirl flow in a peripheral direction of a premixer is provided within the premixer, and the swirl flow producing means comprises a fuel injection portion provided at a center portion of an inlet portion of the premixer, and a swirl vane member mounted around the fuel injection portion, and a structural member for producing a vortex having an axis of rotation thereof extending in a direction of a main stream of a premixture is provided within the premixer.

The first and second objects are also achieved by a construction in which a premixer contains a structural member for producing a vortex having an axis of rotation thereof extending in a direction of a main stream of a premixture, and means for producing a swirl flow in a peripheral direction of the premixer is provided at an inlet portion of the premixer, and this swirl flow producing means comprising a fuel injection portion provided at a center portion of the inlet portion, and a slit portion provided at a side surface of the premixer for supplying the air in a direction tangential to this side surface.

The first and second objects are also achieved by an operation method in which after air and fuel are injected separately to effect a diffusion combustion, a premixture is mixed using a vortex having an axis of rotation thereof extending in a direction of a main stream of the premixture, and is burned to achieve a premixture combustion.

The first and second objects are also achieved by an operation method comprising a first step of injecting air and fuel separately to effect a diffusion combustion, and a second step of mixing a premixture together, using a vortex having an axis of rotation thereof extending in a direction of a main stream to effect diffusion combustion and a premixture combustion. Preferably, in the second step, a flow rate of air and fuel for the premixture combustion is increased while a flow rate of air and fuel for the diffusion combustion is decreased. Preferably, a flow rate of air and fuel for the diffusion combustion is decreased, and then is kept constant.

Preferably, in order to achieve the first and second objects, there is used an operation method which comprises a first step of injecting air and fuel separately to effect a diffusion combustion, and a second step of effecting a diffusion combustion and a first premixture combustion for burning a first premixture obtained by using a vortex having an axis of rotation thereof extending in a direction of a main stream, and a third step of effecting a premixture combustion of a second premixture, mixed with the premixture combustion of the first premixture and the diffusion combustion, using the vortex. Preferably, in the second step, a flow rate of the first premixture is increased while a flow rate of air and fuel for the diffusion combustion is decreased, and in the third step, a flow rate of the second premixture is increased while a flow rate of air and fuel for the diffusion combustion, as well as a flow rate of the first premixture, is kept constant.

The third object is achieved by a construction in which there are provided a plurality of combustors each comprising (i) a pilot burner provided at a center portion thereof, and (ii) a plurality of premixers arranged peripherally in surrounding relation to the pilot burner, and the plurality of combustors are interconnected by flame propagation pipes at their outer peripheral portions disposed on a straight line on which some of the premixers as well as the pilot burner, are disposed, the directions of swirling of swirl flows, discharged respectively from these premixers, being generally the same.

In the present invention, the structural member for producing a vortex having an axis of rotation thereof extending in a direction of the main stream of the premixture is provided within the premixer. With this arrangement, air and fuel can be mixed together spatially uniformly within the premixer, using the large mixing effects achieved by a peripheral flow about the center axis of the vortex and radial flows due to the pressure difference between the center and peripheral portion of the vortex. Therefore, an amount of NOx produced can be reduced. At the outlet of the premixer, there are produced flows from the peripheral portion (high-pressure portion) of the vortex toward the center (low-pressure portion) of the vortex, and therefore a pressure at the center of the vortex is higher at the outlet than within the premixer, so that a flow toward the upstream side is produced. As the vortex proceeds in the main stream direction, the radius of rotation of the vortex is increasing. Also, as the vortex proceeds in the main stream direction, the angular momentum of the vortex is increasing. Therefore, circulating flows can be formed at the outlet of the premixer, and the main stream can be formed outside these circulating flows. This prevents the blowing-out of flame, and prevents a back fire, thereby stabilizing flame. Moreover, when such a mixing effect by the vortex is used, air and fuel can be mixed together in a short time to obtain the premixture, and therefore the premixer can be of a small size.

The structural member, having an angle of elevation with respect to the direction of the main stream of the premixture, is provided within the premixer, and this structural member has a portion which is not in contact with the inner surface of the premixer. With this arrangement, the strong vortex called "Lanchester vortex" is produced by a three-dimensional effect with respect to the lift of the structural member. Therefore, because of the above effects of the vortex, flame can be stabilized, and NOx can be reduced in amount even if the premixer is of a small size.

Preferably, means for producing a turbulence is provided on the structural member, and turbulence (having no directional property), produced by this means, and vortex, produced by the structural member, are combined together to enhance the effect of mixing air and fuel. This turbulence also serves to prevent a flow separation phenomenon in which the main stream of the premixture separates from the surface of the structural member. This enhances the mixing effect, thereby reducing an amount NOx produced.

Preferably, a plurality of vortex-producing means are provided on the structural member, and a plurality of vortexes, produced by the vortex-producing means, and vortex, produced by the structural member, are combined together to enhance the effect of mixing the air and fuel.

Preferably, a plurality of structural members are provided, and vortexes, produced respectively from these structure members, interfere with one another, and are destroyed in configuration to provide a turbulent condition. As a result, the effect of mixing the premixture can be further enhanced.

The plurality of structural members each for producing a vortex having an axis of rotation thereof extending in a direction of a main stream of the premixture are provided within the premixer, and the vortexes produced downstream of the plurality of structural members are combined together to form one vortex. With this arrangement, also, because of a similar effect as described above, flame can be stabilized, and NOx can be reduced even if the premixer is of a small size.

Three structural members each for producing a vortex having an axis of rotation thereof extending in a direction of a main stream of the premixture are provided within the premixer, and these structural members are so arranged as to satisfy the following formulas:

$$\Gamma_1\cdot\Gamma_2+\Gamma_2\cdot\Gamma_3+\Gamma_3\cdot\Gamma_1=0 \quad (1)$$

$$\Gamma_1\cdot\Gamma_2 r_{12}^2+\Gamma_2\cdot\Gamma_3\cdot r_{23}^2+\Gamma_3\cdot\Gamma_1\cdot r_{31}^2=0 \quad (2)$$

where $\Gamma_1$, $\Gamma_2$ and $\Gamma_3$ respectively represent the circulations (the intensity of the premixture vortex tube about the center axis) of the vortexes produced respectively by these structural members, and $r_{12}$, $r_{23}$, $r_{31}$ ($r_{ij}$ represents the distances between the centers of the vortexes $_i$ and $_j$) represents distances between the centers of the adjacent vortexes.

With this arrangement, the three vortexes can be combined together to form one vortex. Therefore, because of a similar effect as described above, flame can be stabilized, and NOx can be reduced even if the premixer is of a small size.

Three structural members each for producing a vortex having an axis of rotation thereof extending in a direction of a main stream of the premixture are provided within the premixer, and the circulations (the rate of flow of the premixture in a vortex about the center axis) of the vortexes produced respectively by these structural members are represented respectively by $\Gamma$, $\Gamma$ and $-\Gamma/2$ (The negative sign indicates that the direction of swirling of the vortex is reverse), and the three structural members are arranged such that the centers of these vortexes are disposed respectively at three apexes of a regular triangle. With this arrangement, also, one vortex can be formed from the three vortexes. Therefore, because of a similar effect as described above, flame can be stabilized, and NOx can be reduced even if the premixer is of a small size.

Preferably, the pressure difference control means for increasing a difference in pressure between the center and peripheral portion of the vortex is provided within the premixer, and is disposed downstream of the structural member. With this arrangement, the intensity of the radial flows, caused by the pressure difference between the center and peripheral portion of the vortex, increases, so that the effect of mixing the premixture is further enhanced.

Preferably, the premixer includes the pressure control means for increasing the pressure at the center of the vortex, this pressure control means being disposed downstream of the pressure difference control means. With this arrangement, flow toward the upstream side is caused by the difference in the pressure of the center of the vortex between the upstream side and the downstream side of the pressure control means. This produces circulating flows within the premixer, and the effect of mixing the premixture can be further enhanced by these circulating flows.

Preferably, the pressure control means for increasing the pressure at the center of the vortex is provided at the inlet portion of the premixer. With this arrangement, flow toward the upstream side is caused by the difference in the pressure of the center of the vortex between the upstream side and the downstream side of the pressure control means. This produces circulating flows at the outlet of the premixer, and therefore the blowing-out of flame is prevented, thereby stabilizing flame.

Preferably, the flow velocity control means for increasing the velocity of flow of the peripheral portion of the vortex is provided at the outlet portion of the premixer. With this arrangement, the flow of high velocity is formed at the peripheral portion of the vortex at the outlet, and therefore back fire of flame is prevented, thereby stabilizing flame.

Preferably, the premixer is arranged in the peripheral direction of the combustor, and the pilot burner for injecting air and fuel separately to effect a diffusion combustion is provided at the outlet of the premixer. With this arrangement, flame can be sufficiently stabilized only by the circulating flows formed at the premixer, and therefore even if the pilot burner is reduced in size, the combustor can be operated in a stable manner. Moreover, the diffusion flame from the pilot burner is instantaneously involved in the vortex of the premixture at the outlet of the premixer, thereby burning the unburnt combustion gas. Therefore, the flame propagation property of the diffusion flame (pilot flame) can be effectively enhanced, thereby further stabilizing flame.

Preferably, the pilot burner for injecting air and fuel separately to effect a diffusion combustion is provided at the center portion of the combustor, and the premixer is arranged peripherally in surrounding relation to the pilot burner. With this arrangement, also, flame can be sufficiently stabilized only by the circulating flows formed at the outlet of the premixer, and therefore the combustor can be operated stably even if the pilot burner is considerably reduced in size.

Preferably, means for producing a swirl flow in a peripheral direction (which is a direction of a main stream) is provided at the inlet of the premixer, and the structural member is provided downstream of the position where the direction of the main stream shifts from the peripheral direction to an axial direction. With this arrangement, the mixing effect achieved by the whirl flow can also be used, and therefore the mixing of the air with the fuel is further enhanced, thereby further reducing NOx.

The premixer contains the structural member for producing the vortex having an axis thereof extending in the direction of the main stream of the premixture, and the circulating flows are formed at the center portion of the outlet portion while the main stream is formed outside these circulating flows. With this arrangement, the blowing-out of flame, as well as a back fire of flame, can be prevented, thereby stabilizing flame. And besides, NOx can be reduced by the effect of the above vortex.

The diffusion combustion flame is formed upstream of the premixture combustion flame produced in the premixer. With this arrangement, an excellent flame stabilizing property achieved by the diffusion combustion flame can be utilized at the outlet of the premixer while an excellent NOx-reducing property achieved by the premixture combustion flame can be utilized at the outlet of the combustor.

The pilot burner for injecting air and fuel separately to effect a diffusion combustion is provided at the center portion of the combustor, and a plurality of premixers are arranged peripherally in surrounding relation to the pilot burner, and each premixer contains the structural member for producing the vortex having the axis thereof extending in the direction of the main stream of the premixture, and the direction of rotation of the vortex, discharged from at least one of the premixers, is opposite to the direction of rotation of the vortexes discharged from the other premixers. With this arrangement, NOx can be reduced by the above effect of the vortex. Flow from the center portion of the combustor to the peripheral portion thereof is induced between the adjacent vortexes having opposite directions of rotation, respectively, and therefore the diffusion flame can be effectively conveyed from the center portion to the premixers. Therefore, the propagation of flame to the premixture can be enhanced, thereby stabilizing flame. Moreover, by operating the plurality of premixers of a small size in a staged manner in accordance with a load, a continuous load operation can be substantially effected.

The pilot burner for injecting air and fuel separately to effect a diffusion combustion is provided at the center portion of the combustor, and a plurality of premixers are arranged in concentric stages in surrounding relation to the pilot burner, and each premixer contains the structural member for producing the vortex having the axis thereof extending in the direction of the main stream of the premixture, and the directions of rotation of the vortexes, discharged respectively from the peripherally and radially adjacent premixers, are opposite to each other. With this arrangement, also, because of a similar effect as described above, an excellent flame stability as well as an excellent NOx-reducing property can be achieved even if the premixers are of a small size, and also the continuous load operation is possible.

A plurality of premixers, each containing the structural member for producing the vortex having the axis thereof extending in the direction of the main stream of the premixture, are provided, and the directions of rotation of the vortexes, discharged respectively from the adjacent premixers, are opposite to each other. With this arrangement, the premixture can be spatially uniformly mixed, thereby reducing NOx. In this case, each vortex induces reverse flows at opposite sides thereof, and these flows enable the combustion gas, burned at the outlet of the premixer in the vicinity of the center of the combustor, to be drawn into the premixers. Thus, each premixer also serves as a pilot burner, and therefore the propagation from the pilot flame can be effectively enhanced, thereby stabilizing flame. Moreover, by operating the plurality of premixers of a small size in a staged manner in accordance with a load, a continuous load operation can be substantially effected.

The first means for swirling a premixture in a peripheral direction is provided, and second means is mounted around the first means for swirling the premixture in the same peripheral direction as the peripheral direction in which the premixture is swirled by the first means, the first and second means being provided at an outlet portion of the premixer. The intensity of whirling of a swirl flow, produced by the first means and representing a ratio of a peripheral flow velocity of the swirl flow to an axial flow velocity, is greater than the intensity of whirling of a whirl flow produced by the second means. Preferably, the intensity of swirling of the swirl flow, produced in the vicinity of the swirl axis by the second means and representing a ratio of the peripheral flow velocity of the swirl flow to the axial flow velocity, is greater than the intensity of the whirl disposed around the swirl flow. With this arrangement, a stagnant region (which creates the causes of the blowing-out of flame and shaking of flame) in the vicinity of the center axis can be reduced. Therefore, the blowing-out of flame is prevented, thereby enhancing the stability of flame.

This effect can be explained by the following theoretical consideration. The following relation is established in the swirl flow field:

$$(\partial P/\partial x)_{r=0}-(\partial P/\partial x)_{r=R}-\partial[(\rho W^2/r)dr/\partial x \quad (3)$$

where P represents a pressure, ρ represents a density, W represents a swirl velocity x represents an axial distance, r represents a radial distance, and R represents a radius of the combustor.

Namely, the pressure gradient at the center axis increases in proportion to a rate of attenuation of the centrifugal force in the axial direction. The larger the pressure gradient at the center axis is, the larger the velocity of the reverse flow is. Therefore, in order to increase the velocity of the reverse flow, it is necessary to decrease the centrifugal force progressively in the downstream direction. As a result, the swirl intensity is made smaller at the outer peripheral portion of the swirl flow than at the inner peripheral portion thereof, so that the velocity of the swirl flow at the inner peripheral portion (r: small) much influencing the centrifugal force can be effectively attenuated in the axial direction. Therefore, the velocity of the reverse flow is increased, thereby enhancing the flame stability.

There are provided a plurality of combustors each comprising a pilot burner provided at a center portion thereof, and a plurality of premixers arranged peripherally in surrounding relation to the pilot burner, and the plurality of combustors are interconnected by flame propagation pipes at their outer peripheral portions disposed on a straight line on which some of the premixers as well as the pilot burner, are disposed, the directions of swirling of swirl flows, discharged respectively from these premixers, being generally the same. With this arrangement, thanks to a flow induced by the swirl flow, flame can be easily propagated from the pilot burner to the premixers disposed at the outer peripheral portion, and also the premixture combustion flame can be positively propagated to the premixers of the other combustors through the flame propagation pipe. The premixture, supplied from each premixer, is burned while keeping flame by the circulating flows formed at the outlet thereof, and therefore the premixture flame can be stabilized.

DESCRIPTION OF THE PREFERRED EMBODIMENTS

A preferred embodiment of the present invention will now be described with reference to the drawings.

Figure 1:
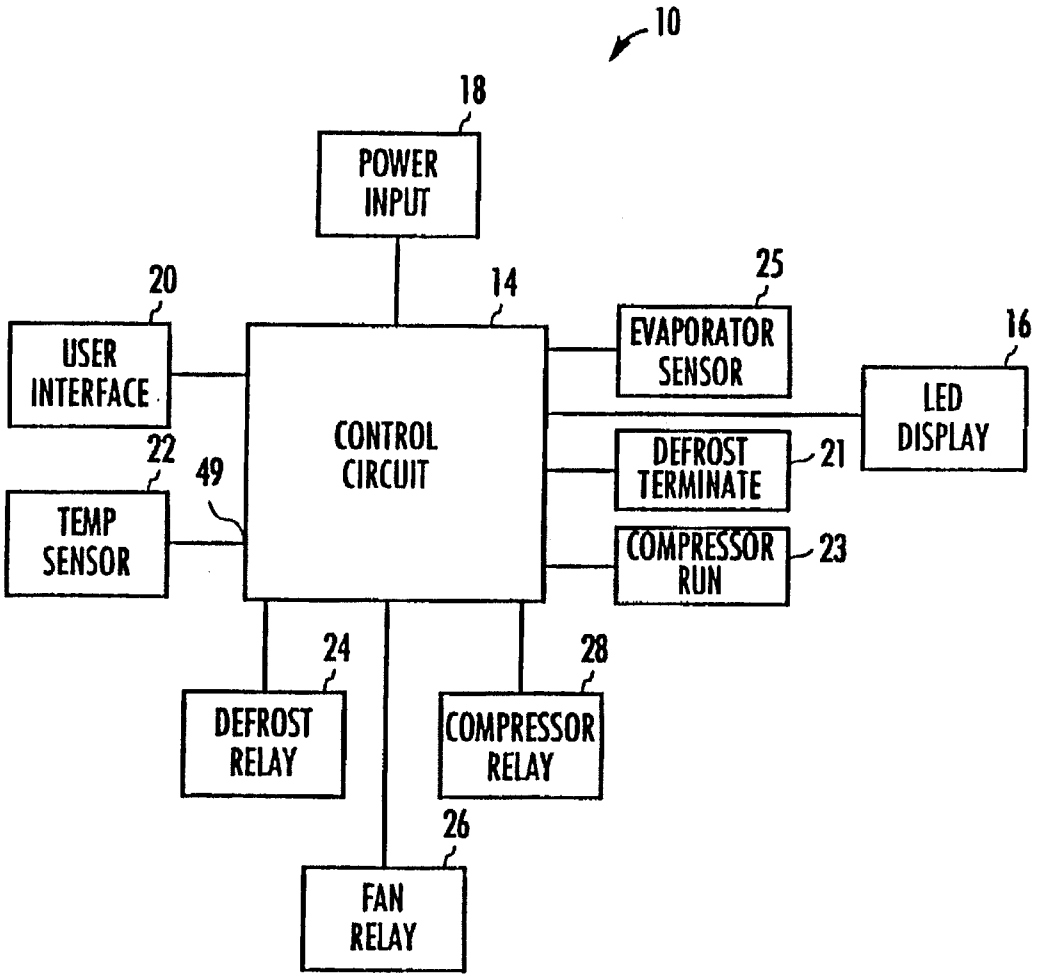
FIG. 1 is a longitudinal cross-sectional view of a gas turbine combustor according to a first embodiment of the present invention.
Figure 2:
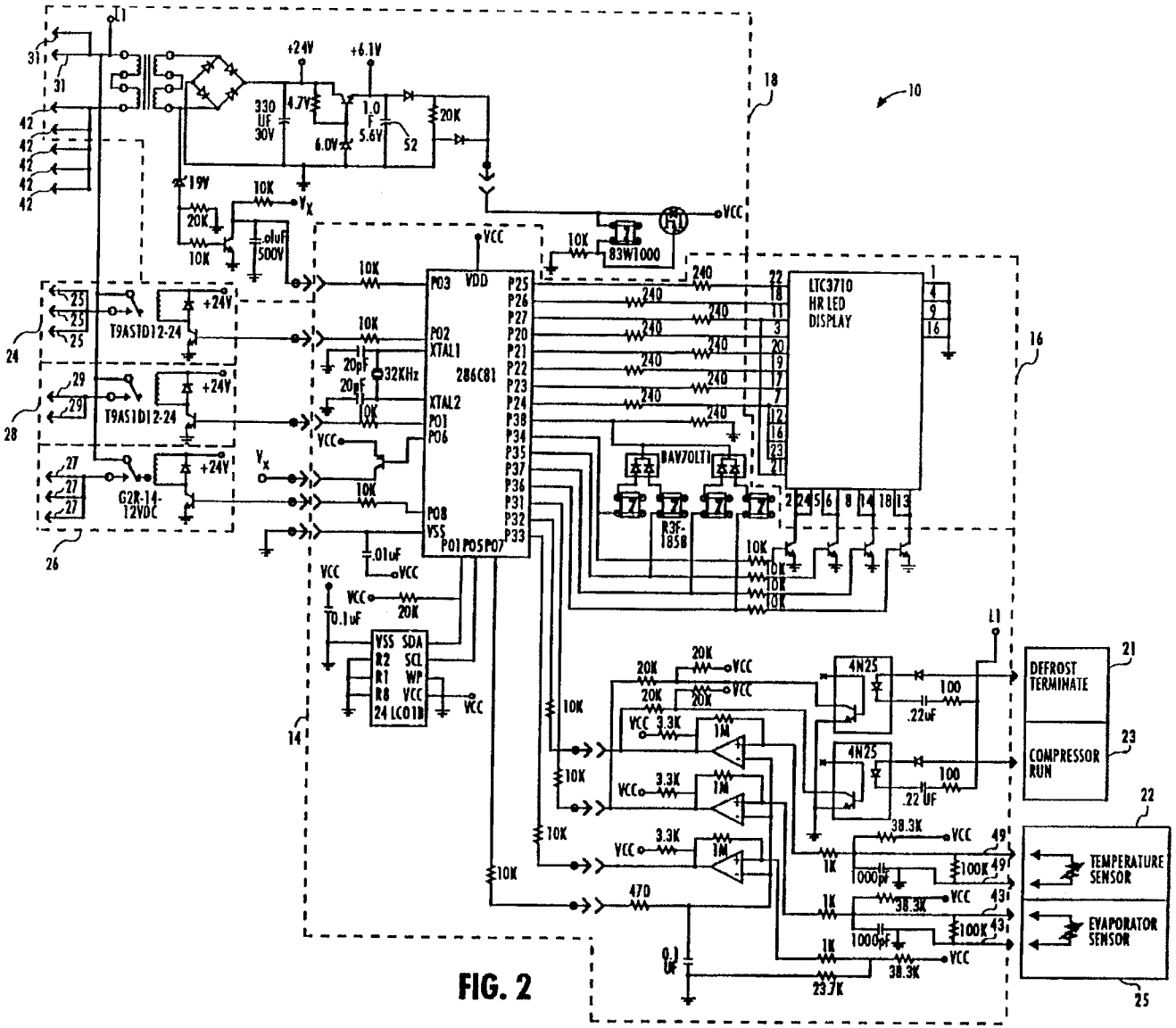
FIG. 2 is a detailed view showing a portion around an outlet of a premixer of FIG. 1.
Figure 3:
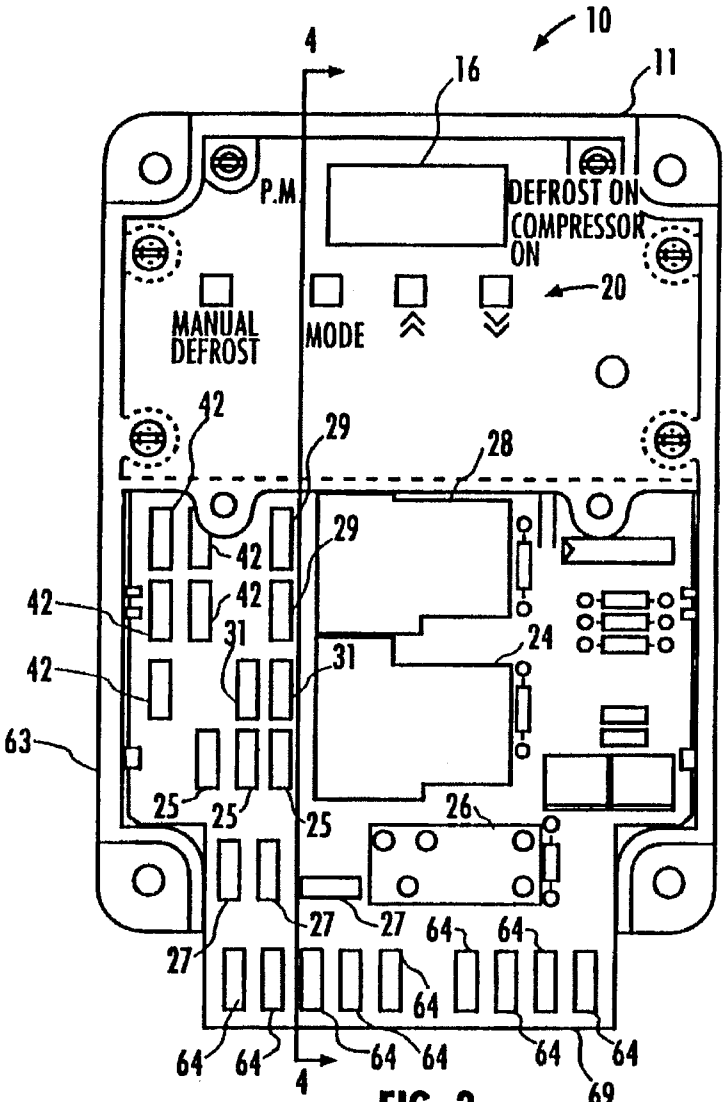
FIG. 3 is a view of a blade-like structural member as seen in a direction of arrow A of FIG. 2.
Figure 1:
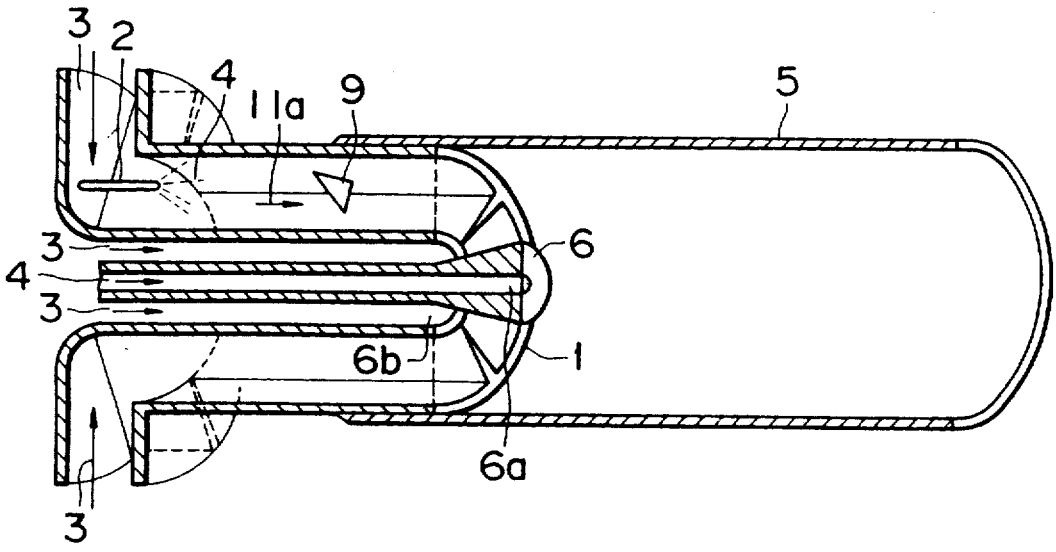
Figure 2:
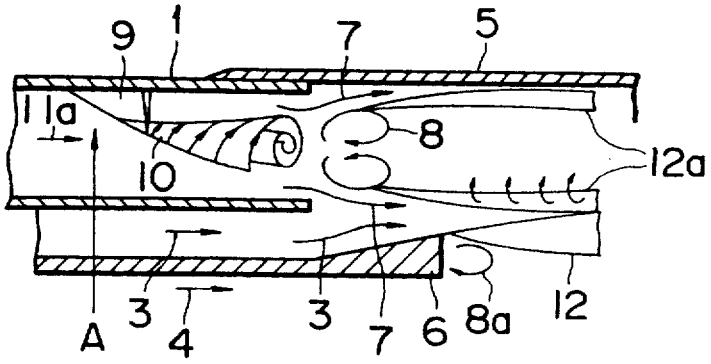
Figure 3:
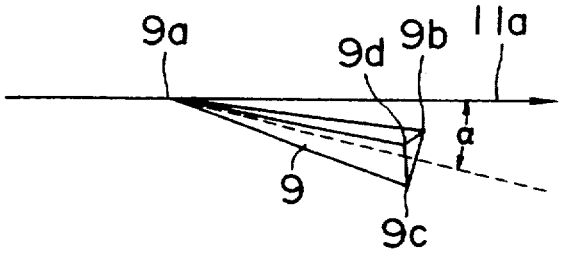
Figure 4:
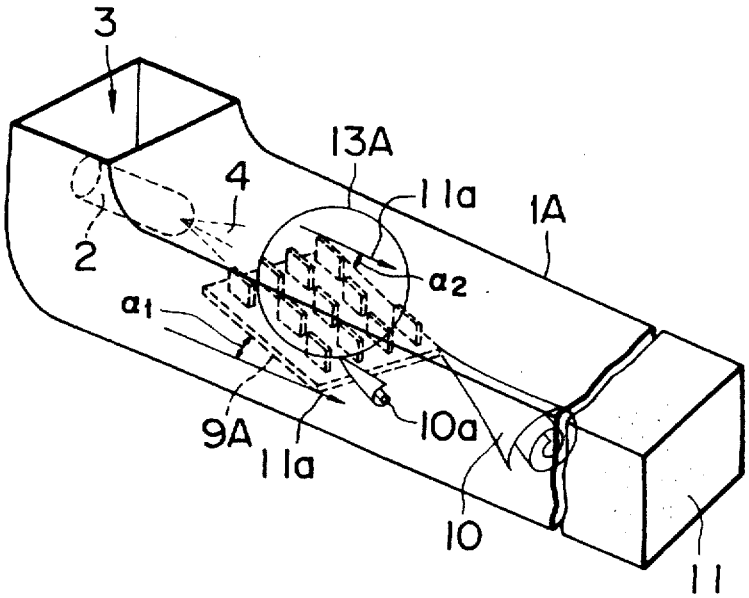

FIG. 1 is a longitudinal cross-sectional view of a gas turbine combustor according to a first embodiment of the present invention, FIG. 2 is a detailed view showing a portion around an outlet of a premixer, and FIG. 3 is a view of a blade-like structural member as seen in a direction of arrow A of FIG. 2.

In the drawings, the combustor 5 of a cylindrical shape comprises a pilot burner 6 provided at its center portion, and the premixer 1 provided in surrounding relation to the pilot burner 6, the pilot burner 6 comprising a fuel injection nozzle 6*a* and an air injection nozzle 6*b*. The premixer 1 has a plurality of premix chambers separated from one another in a circumferential direction. Within each of the premix chambers, a fuel injection nozzle 2 is provided at an inlet portion thereof, and the blade-like structural member 9 is provided on an inner surface of the premix chamber at a position downstream of this fuel injection nozzle 2, this structural member 9 having a suitable angle α of elevation with respect to a direction 11*a* of a main stream of a fuel-air premixture. As shown in FIG. 3, the blade-like structural member 9 is of a triangular pyramid-shape, and is fixedly secured to the inner surface of the premix chamber in such a manner that its triangular surface having three apexes 9*a*, 9*b* and 9*c* (a line (indicated by a broken line in FIG. 3) passing through the apex 9*a* and a mid point of a side 9*b*–9*c* (extending between the apexes 9*b* and 9*c*)) is disposed at an angle α of elevation with respect to the direction 11*a* of the main stream of the fuel-air premixture.

In the premixer 1, combustion air 3, fed from the inlet, and fuel 4, injected from the fuel injection nozzle 2, are mixed together through diffusion to form a fuel-air premixture 11 which flows through the premixer 1. At this time, a vortex (longitudinal vortex) called "Lanchester vortex", having an axis (centerline) of rotation extending in the direction of the main stream of the premixture 11, is formed rearwardly or downstream of that end (that is, the projected portion defined by the apex 9*d* in FIG. 3) of the blade-like structural member 9 remote from the inner surface of the premixer 1. This Lanchester vortex 10 is directed toward an outlet of the premixer 1, while whirlingly mixing fuel and air together. The flow of the Lanchester vortex 10 includes the flow in the direction of the main stream in the premix chamber, and the flow swirling about an axis extending in the direction of this main stream, and a flow rate in the direction of the main stream is more than a half of the total flow rate of the Lanchester vortex. As the Lanchester vortex 10 proceeds downstream, the radius of rotation (swirling) of the vortex, as well as an angular momentum, is increasing, thereby producing a vigorous mixing effect. The fuel-air premixture is mixed spatially uniformly by this mixing effect of the Lanchester vortex 10, and therefore any localized high-temperature region will not be produced, so that an amount of NOx produced can be reduced.

In the premix chamber, the Lanchester vortex is higher in pressure at its peripheral portion than at its center, but at the outlet of the premix chamber, flows from the peripheral portion (high-pressure portion) to the center portion (low-pressure portion) is produced, so that the pressure at the center of the vortex is increased. As a result, the pressure at the center of the vortex is higher at the outlet of the premix chamber than within the premix chamber, and therefore flow toward the upstream side is caused by this pressure difference, thereby forming circulating flows 8. The blowing-out of a premixture flame 12*a* is prevented by these circulating flows 8, thereby stabilizing flame. And besides, the main stream 7, flowing outside the circulating flows 8, serves to prevent back fire of the premixture flame 12*a*, and this further stabilizes flame. In FIG. 3, although the blade-like structural member 9 is tilted clockwise with respect to the main stream direction 11*a* to obtain the elevation angle α, the blade-like structural member 9 may be tilted counterclockwise with respect to the main stream direction 11*a* to produce a Lanchester vortex 10 whirling in a reverse direction.

In this embodiment, a flow rate of the Lanchester vortex 10 swirling about the axis extending in the direction of the main stream is set to the range of 30–50% of the total flow rate of the Lanchester vortex 10, and by doing so, the above uniform mixing of the fuel-air premixture 11, as well as the above stabilization of the premixture flame 12*a*, can be effectively achieved. For achieving such a flow rate distribution, the elevation angle $\alpha$ of the blade-like structural member 9 is set to 10°–20°, and the height of this member from the inner surface of the premix chamber in a plane perpendicular to the main stream is set to 30–50% of the average inner diameter of the premix chamber in said perpendicular plane. At this time, a flow separation phenomenon, in which the flow of the premixture 11 separates from the surface of the blade-like structural member 9, is suppressed, thereby further enhancing the effect of mixing the premixture 11. A diffusion flame 12 is formed downstream of the pilot burner 6, and therefore the stabilization of the premixture flame 12*a* is further enhanced.

The above effect of the Lanchester vortex can be obtained satisfactorily even if the premix chamber is of a small size, and therefore even if the combustor 5 is of a small size, flame can be made stable, and NOx can be reduced. Therefore, by providing a plurality of premix chambers of a small size as in this embodiment, or a plurality of combustors of a small size, and by operating these in a staged manner in accordance with load, a continuous load operation can be substantially carried out. With this construction, ununiformity of the fuel-air premixture constituting the cause of production of NOx, as well as the formation of any high-temperature region in the premixture flame due to this ununiformity, can be suppressed to a maximum degree, and therefore a very low NOx concentration on the order of less than 10 ppm can be achieved.

Next, a method of operating the gas turbine combustor of this embodiment will now be described. When the combustor 5 is to be started up, the pilot burner 6 is first started up, and a flow rate of air 3 and a flow rate of fuel 4 supplied to this pilot burner are gradually increased, thereby increasing a diffusion combustion output. Then, at the time when the output reaches a predetermined proportion of the rated output, the premixer 1 is activated, and the amount of flow of the fuel-air premixture 11 is increased, thereby increasing a premixture combustion output. At this time, a flow rate of air 3 and a flow rate of fuel 4 supplied to the pilot burner 6 are reduced to decrease the ratio of the diffusion combustion output to the premixture combustion output, thereby reducing an amount of NOx produced to a low level. At the time when the output reaches the rated level, a flow rate of air 3 and a flow rate of fuel 4 supplied to the premixer 1, as well as a flow rate of air 3 and a flow rate of fuel 4 supplied to the pilot burner 6, are kept constant, and the combustor 5 is operated at its rated output. When the combustor 5 is to be stopped, an operation reverse to the start-up operation is carried out. By suitably determining the above-mentioned predetermined proportion, the low NOx characteristics of the premixture flame can be efficiently utilized while compensating for the instability of the premixture flame in the low-output condition by the stability of the diffusion flame. Therefore, the combustor can be operated at a low NOx-production rate with an excellent flame stability. By controlling an increase in the output of the plurality of premix chambers of the premixer 1 in a stepwise manner, the combustor can carry out a substantially continuous load operation. In this embodiment, although the vortex is produced in the premix chamber by the structural member, the invention is not limit to such a construction, and any suitable means, including modified forms of the premixer and rotary blades as described later, may be used in so far as it can produce a vortex in the premixer, and will not affect the operation of the combustor.

Figure 4:
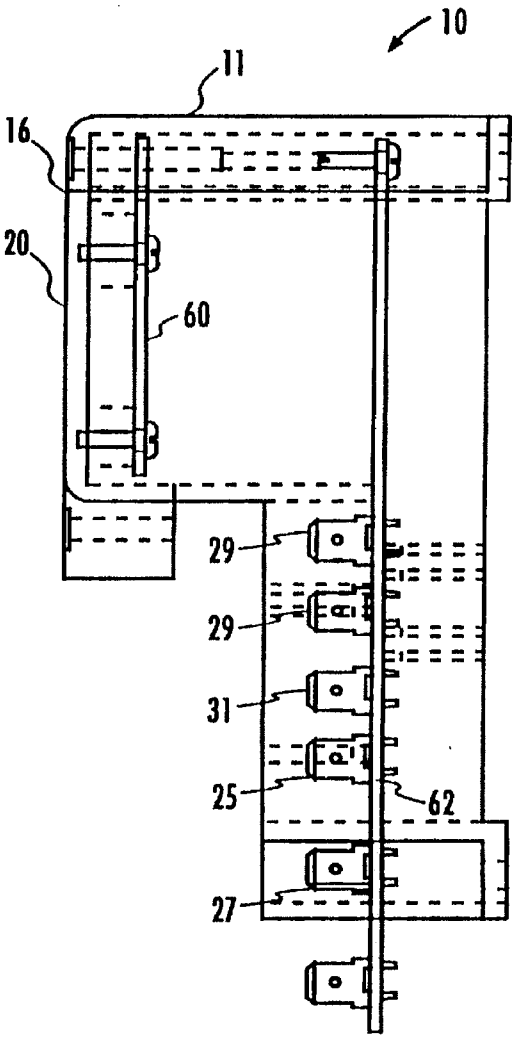
FIG. 4 is a view showing a premixer according to a second embodiment of the present invention.

FIG. 4 is a view showing a premixer according to a second embodiment of the present invention. In this embodiment, a blade-like structural member 9A, having a suitable angle $\alpha_1$ of elevation with respect to a direction 11*a* of a main stream of a fuel-air premixture, is mounted on an inner surface of a premixer 1A, and a plurality of small blades 13A each having a suitable angle $\alpha_2$ of elevation with respect to the direction 11*a* of the main stream are mounted on the blade-like structural member 9A. In the premixer 1A, combustion air 3, supplied from an inlet of this premixer, and fuel 4, injected from a fuel injection nozzle 2, are mixed together through diffusion to form a fuel-air premixture which flows through the premixer 1A. Because of a similar effect as in the first embodiment, a Lanchester vortex 10 of the fuel-air premixture is formed rearwardly or downstream of a free end of the blade-like structural member 9, and also a plurality of small Lanchester vortexes 10*a* are formed by the small blades 13A, respectively. These small Lanchester vortexes 10*a* interfere with one another, and swirlingly mix fuel and air together, and reach an outlet of the premixer while being involved in the larger Lanchester vortex, and are burned at the outlet. In this embodiment, by the combination of a plurality of small Lanchester vortexes 10*a* and one larger Lanchester vortex 10, a fuel-air premixture 11 formed in the premixer 1A is mixed more uniformly than in the first embodiment. By setting the elevation angle $\alpha_1$, $\alpha_2$ to the range of 10°–20° as described above in the first embodiment, the above effect can be obtained. The small Lanchester vortexes 10*a*, produced by the plurality of small blades 13A, serve to suppress a flow separation phenomenon, in which the main stream of the fuel-air premixture separates from the surface of the blade-like structural member 9A, if the elevation angle of the blade-like structural member 9A is large, and therefore the mixing of the fuel-air premixture is promoted by this effect. Therefore, the production of any localized high-temperature region due to the unevenness of the concentration is prevented, so that the NOx-reducing effect can be further enhanced.

In this embodiment, the plurality of small blades 13A have the same elevation angle $\alpha_2$; however, even if any of these small blades 13A may have an elevation angle different from the value $\alpha_2$, the above effect can be obtained. Instead of the small blades 13A, turbulence-producing means such as wires may be mounted on the blade-like structural member 9A perpendicularly to the direction of the main stream of the fuel-air premixture 11, in which case a similar effect as described above can be obtained.

Figure 5:
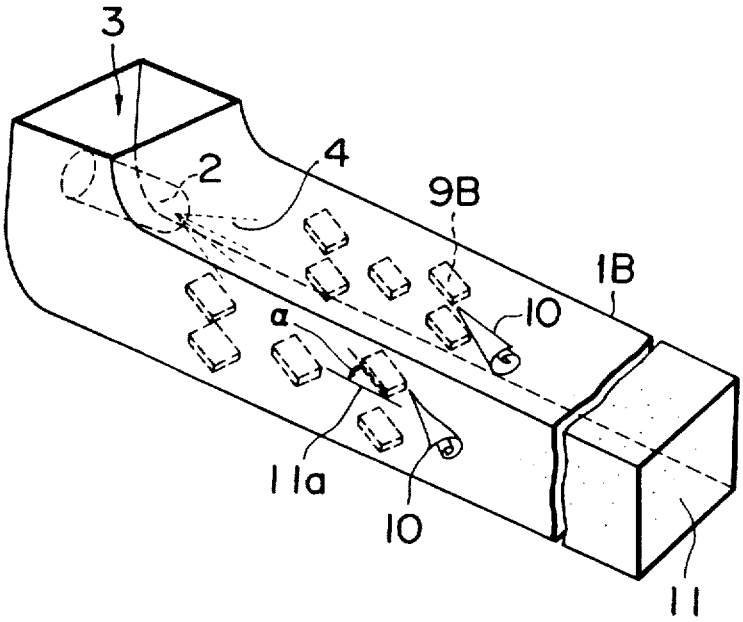
FIG. 5 is a view showing a premixer according to a third embodiment of the present invention.

FIG. 5 is a view showing a premixer according to a third embodiment of the present invention. In this embodiment, a plurality of blade-like structural members 9B, each having a suitable angle $\alpha$ (10°–20°) with respect to a direction 11*a* of a main stream of a fuel-air premixture, are mounted on an inner surface of the premixer 1B. In the premixer 1B, combustion air 3, supplied from an inlet of this premixer, and fuel 4, injected from a fuel injection nozzle 2, are mixed together through diffusion to form a fuel-air premixture which flows through the premixer 1B. Because of a similar effect as in the first embodiment, a Lanchester vortex 10 of the fuel-air premixture is formed rearwardly or downstream of a free end of each of the plurality of blade-like structural members 9B. A plurality of Lanchester vortexes 10 thus formed interfere with one another, and whirlingly mix fuel and air, so that their vortex configurations are destroyed to provide a turbulent condition. The thus mixed fuel-air premixture 11 is burned at an outlet of the premixer. In this embodiment, the fuel-air premixture formed in the premixer 1 is mixed more uniformly by a synergetic mixing effect achieved by the plurality of Lanchester vortexes 10. Therefore, as in the above embodiments, the NOx-reducing effect can be further enhanced.

Figure 6:
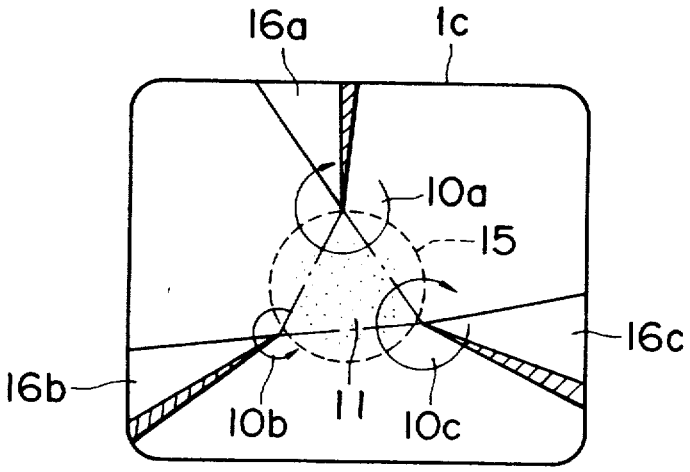
FIG. 6 is a transverse cross-sectional view of a premixer according to a fourth embodiment of the present invention.

FIG. 6 is a transverse cross-sectional view of a premixer according to a fourth embodiment of the present invention. In this embodiment, three delta blades 16*a*, 16*b* and 16*c* of a triangular pyramid-shape (which have the same construction as shown in FIG. 3), having a suitable angle of elevation with respect to a direction of a main stream of a fuel-air premixture, are mounted on an inner surface of the premixer 1C of a square cross-section. The height of the delta blades 16*b* and 16*c* in the transverse direction (FIG. 6) is set to one third of a distance between the opposed portions of the inner surface of the premixer 1C, and also the height of the delta blade 16*a* in the vertical direction is set to one third of the opposed portions of the inner surface of the premixer 1C, so that the tips of the three delta blades are disposed respectively at three apexes of a regular triangle. In this arrangement, an elevation angle of each of these delta blades is adjusted in the range of 10°–20° in such a manner that the circulation of Lanchester vortexes 10*a* and 10*b* formed respectively by the delta blades 16*a* and 16*c* is $\Gamma$ while the circulation of a Lanchester vortex 10*b* formed by the delta blade 16*b* is $-\Gamma/2$ (The negative sign indicates that the direction of rotation (swirling) of the vortex is reverse). With this arrangement, the three Lanchester vortexes 10, formed respectively by the delta blades, satisfy the conditions of the above-mentioned formulas 1 and 2, and therefore are combined together while forming a spiral orbit, thereby forming one strong Lanchester vortex 15. In this embodiment, the fuel-air premixture 11, formed in the premixer 1C, is mixed more uniformly by the effect of the strong Lanchester vortex 15, and therefore the production of any localized high-temperature region due to the unevenness of the concentration is prevented, and the NOx-reducing effect can be enhanced further.

Figure 7:
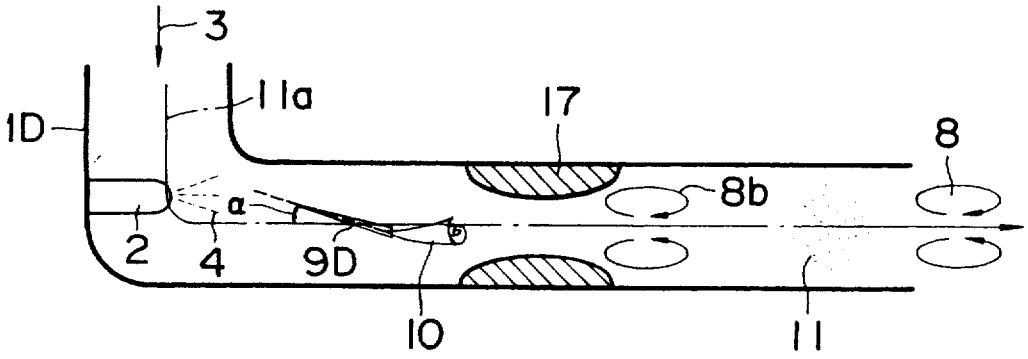
FIG. 7 is a longitudinal cross-sectional view of a premixer according to a fifth embodiment of the present invention.

FIG. 7 is a longitudinal cross-sectional view of a premixer according to a fifth embodiment of the present invention. In this embodiment, a blade-like structural member 9D, having a suitable angle $\alpha$ of elevation with respect to a direction 11*a* of a main stream of a premixture, is mounted on an inner surface of the premixer 1D, and a throat portion 17, having a combination of a constricted flow passage and an enlarged flow passage, is provided downstream of the blade-like structural member 9D. When a Lanchester vortex 10, formed by the blade-like structural member 9D, passes through the constricted flow passage of the throat portion 17, this vortex is extended or elongated in the direction of the main stream, so that the pressure difference between the center of the vortex and its peripheral portion increases, and therefore the stronger longitudinal vortex is obtained. The mixing of air with a fuel is further promoted by a mixing effect of radial flows caused by the pressure difference between the center and peripheral portion of this strong vortex. During the passage of the Lanchester vortex 10 through the enlarged flow passage of the throat portion 17, there develops a flow from the high-pressure portion (the peripheral portion of the vortex) to the low-pressure portion (the center of the vortex), so that the pressure at the center of the vortex increases. Because of the difference in pressure at the vortex center between the upstream side and downstream side of this enlarged flow passage, a flow toward the upstream side is produced. As a result, circulating flows 8*b* are formed within the premixer 1D, and the fuel-air premixture 11 can be further mixed by these circulating flows 8. Therefore, the NOx-reducing effect can be further enhanced. The blowing-out of flame can be prevented by circulating flows 8 formed at an outlet of the premixer 1D, thereby stabilizing flame. In this embodiment, although only one blade-like structural member 9D is provided, three blade-like structural members 9D may be provided in the premixer so as to form one Lanchester vortex as described above, in which case a similar effect can also be achieved.

Figure 8:
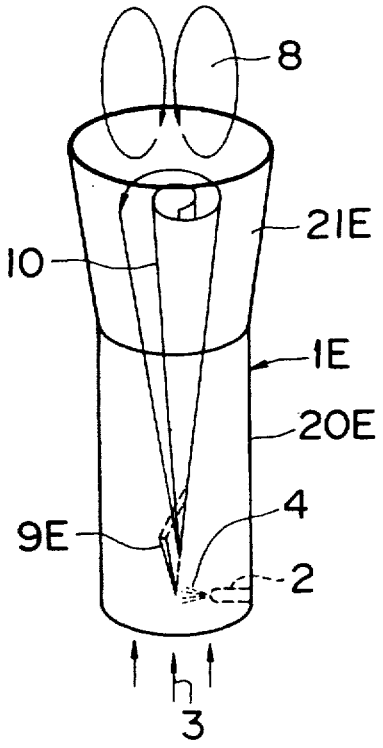
FIG. 8 is a view showing a premixer according to a sixth embodiment of the present invention.

FIG. 8 is a view showing a premixer according to a sixth embodiment of the present invention. In this embodiment, a body of the premixer is constituted by a cylindrical container 20E containing a blade-like structural member 9E having a suitable angle of elevation with respect to a direction of a main stream of a fuel-air premixture. A diffuser 21E serving as an enlarged flow passage is provided at an outlet of the cylindrical container 20E. Combustion air 3 is supplied into the premixer from an inlet of the cylindrical container 20E, and fuel 4 is injected from a fuel injection nozzle 2 provided at the inlet of the premixer. As in the first embodiment, a Lanchester vortex 10 formed by the blade-like structural member 9E is directed toward the outlet of the premixer, while mixing air and fuel together. At the diffuser 21E, there develops a flow from a high-pressure portion (peripheral portion of the Lanchester vortex 10) to a low-pressure portion (the center of the vortex), so that the pressure at the vortex center increases. Therefore, because of the difference in pressure at the center of the Lanchester vortex 10 between the cylindrical container 20E and the diffuser 21E, circulating flows 8 are produced in the diffuser 21E. These circulating flows 8 prevent the blowing-out of flame, thereby stabilizing the flame satisfactorily.

Figure 9:
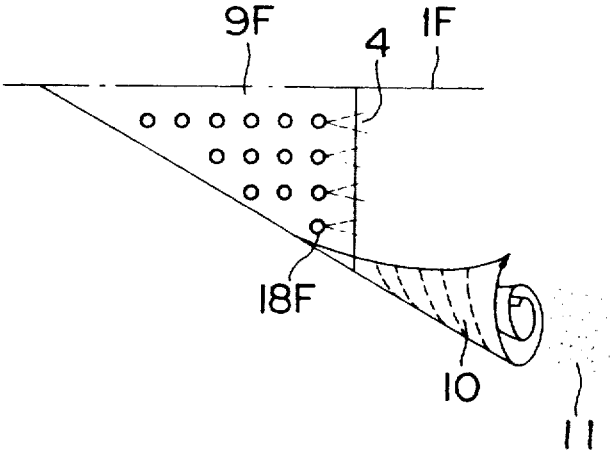
FIG. 9 is a view showing a blade-like structural member in a premixer according to a seventh embodiment of the present invention.

FIG. 9 is a view showing a blade-like structural member provided within a premixer according to a seventh embodiment of the present invention. The blade-like structural member 9F for forming a Lanchester vortex 10 is mounted on an inner surface of the premixer 1F, and a plurality of fuel injection holes 18F are formed in a surface of the blade-like structural member 9F. Fuel 4 is supplied into the premixer 1F from these injection holes 18F. With this arrangement, also, the mixing of air 3 (which is supplied from an inlet of the premixer 1F) with fuel can be promoted at a region rearwardly of the blade-like structural member 9F, that is, at a region where a Lanchester vortex 10 is formed, thereby reducing NOx.

Figure 10:
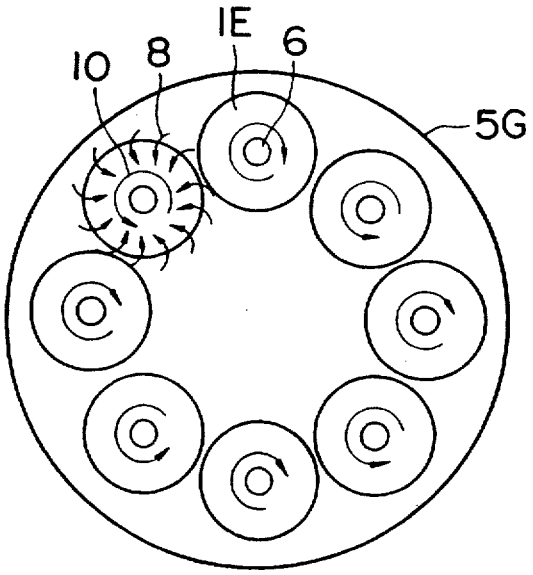
FIG. 10 is a transverse cross-sectional view of a gas turbine combustor according to an eigth embodiment of the present invention.

FIG. 10 is a transverse cross-sectional view of a gas turbine combustor according to an eigth embodiment of the present invention. In this embodiment, eight premixers 1E shown in FIG. 8 are arranged in a direction of the circumference of the combustor 5G, and a small-size pilot burner 6, comprising a fuel injection nozzle and an air injection nozzle, is provided at a central portion of an outlet of each of the premixers 1E. As described above, since circulating flows 8 are formed at the outlet of each premixer 1E, flame can be stabilized by the effect of these circulating flows. Therefore, even if each pilot burner 6 is reduced in size, the combustor can be operated in a stable manner. A diffusion flame produced by each pilot burner 6 is involved in a Lanchester vortex 10, discharged from the outlet of the associated premixer 1E, to burn an unburnt fuel-air premixture. As a result, the propagation of the flame to the fuel-air premixture can be effectively enhanced. In this embodiment, even if each pilot burner is reduced in size, flame can be stabilized, and also NOx can be reduced.

Figure 11:
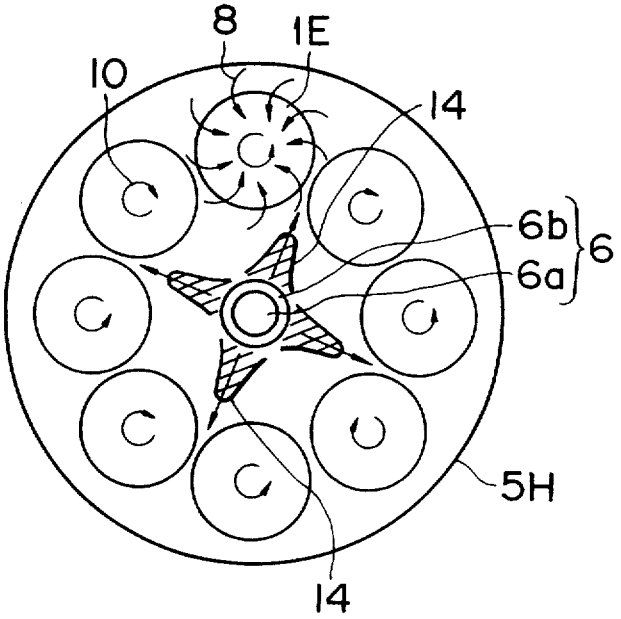
FIG. 11 a transverse cross-sectional view of a gas turbine combustor according to a ninth embodiment of the present invention.

FIG. 11 is a transverse cross-sectional view of a gas turbine combustor according to a ninth embodiment of the present invention. In this embodiment, a pilot burner 6, comprising a fuel injection nozzle 6*a* and an air injection nozzle 6*b*, is provided at a center portion of the combustor 5H, and a plurality of premixers 1E shown in FIG. 8 are circumferentially arranged in surrounding relation to the pilot burner 6. The premixers 1E are arranged such that the directions of rotation (swirling) of Lanchester vortexes 10, discharged respectively from any two adjacent ones of the premixers 1E, are opposite to each other. By thus making the directions of the adjacent Lanchester vortexes 10 opposite to each other, flows 14 from the center of the combustor 5H to the premixers are induced. A diffusion flame, formed at an outlet of the pilot burner 6, is directed or conveyed to the premixers 1E by the flows 14 to burn an unburnt fuel-air premixture. As described above, the fuel-air premixture supplied from each premixer 1E is burned while stabilizing flame by circulating flows 8 formed at an outlet thereof, and therefore the stabilization of the premixture flame is achieved. Therefore, in this embodiment, NOx can be reduced, and the propagation of the flame to the fuel-air premixture is enhanced, and flame can be stabilized. In this embodiment, the directions of the Lanchester vortexes, discharged respectively from any two adjacent premixers 1E, are reverse to each other; however, if the direction of at least one of the Lanchester vortexes is reverse, flows 14 are produced adjacent to this vortex, and therefore the premixture flame can be similarly stabilized.

Figure 12:
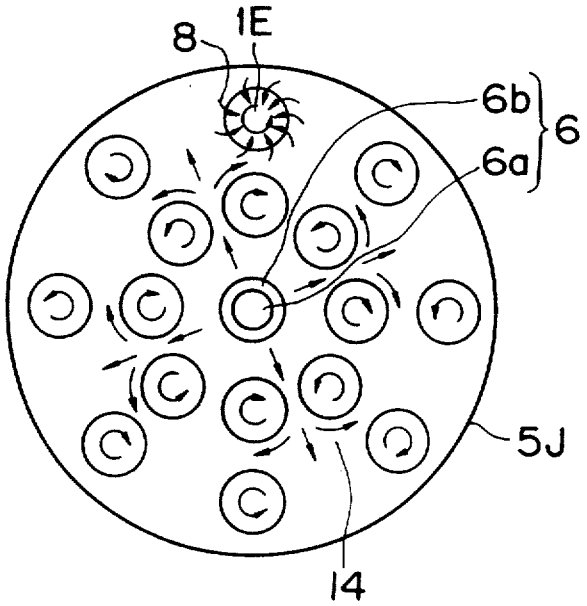
FIG. 12 is a transverse cross-sectional view of a gas turbine combustor according to a tenth embodiment of the present invention.

FIG. 12 is a transverse cross-sectional view of a gas turbine combustor according to a tenth embodiment of the present invention. In this embodiment, a pilot burner 6, comprising a fuel injection nozzle 6*a* and an air injection nozzle 6*b*, is provided at the center portion of the combustor 5J, and premixers 1E shown in FIG. 8 are arranged in two concentric stages in surrounding relation to the pilot burner 6. The premixers 1E are arranged such that the directions of rotation (swirling) of Lanchester vortexes 10, discharged respectively from any two circumferentially and radially adjacent premixers 1E, are opposite to each other. By also making the directions of the adjacent Lanchester vortexes 10 in the radially-arranged stages opposite to each other, flows 14 from the center of the combustor toward the premixers are induced. Such flows 14 can be produced more effectively by increasing the number of the stages of the premixers in the radial direction. Therefore, because of a similar effect as in the ninth embodiment of FIG. 11, NOx can be reduced, and flame can be stabilized.

Figure 13:
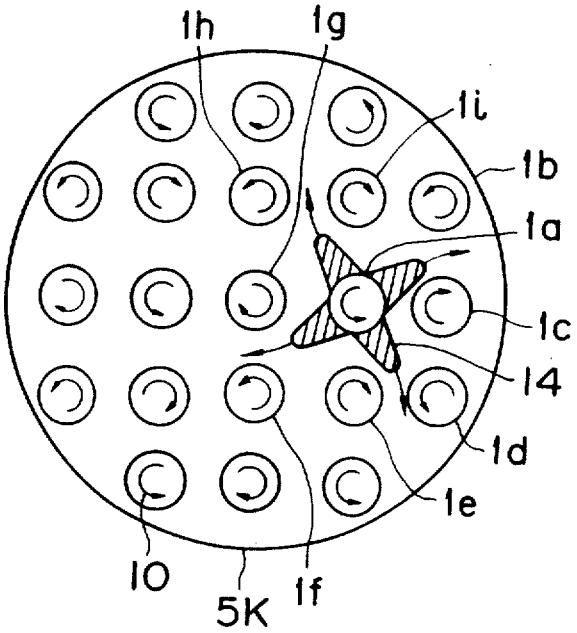
FIG. 13 is a transverse cross-sectional view of a gas turbine combustor according to an eleventh embodiment of the present invention.

FIG. 13 is a transverse cross-sectional view of a gas turbine combustor according to an eleventh embodiment of the present invention. In this embodiment, premixers shown in FIG. 8 are arranged in a lattice-like manner within the combustor 5K, and the directions of rotation of Lanchester vortexes 10, discharged respectively from any two adjacent ones of the premixers, are opposite to each other at lattice points. One premixer (for example, the premixer 1*a*) at the lattice point is surrounded by a maximum of eight premixers (the premixers 1*b* to 1*i*). Since the directions of the adjacent Lanchester vortexes discharged respectively from the eight premixers are opposite to one another, flows 14 from the central premixer 1*a* toward those premixers surrounding this premixer 1*a* are induced, so that combustion gas, burned at an outlet of the premixer 1*a*, is drawn to these surrounding premixers. This effect is produced at each of the lattice points. Therefore, each of the premixers serves also as a pilot burner, and therefore a flame propagating property is enhanced effectively, and flame can be stabilized. Moreover, since any diffusion combustion is not included, the production of NOx can be easily suppressed.

Figure 14A:
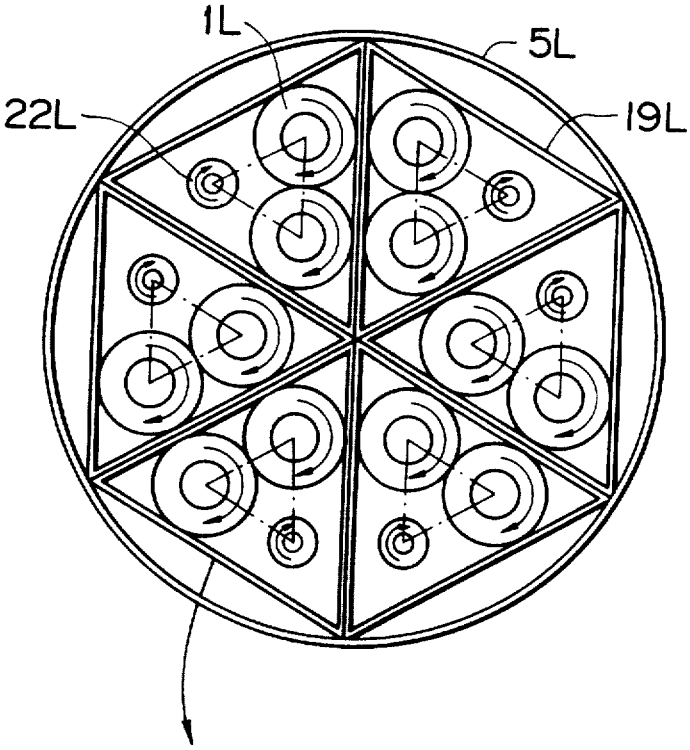
FIG. 14A is a transverse cross-sectional view of a gas turbine combustor according to a twelfth embodiment of the present invention.
Figure 14B:
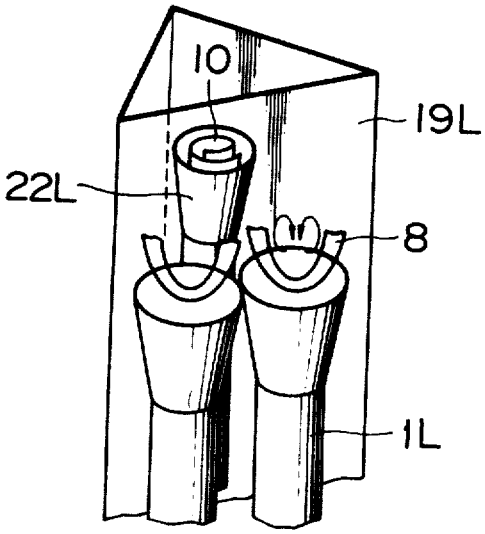
FIG. 14B is a perspective view of a portion of the gas turbine combustor of the twelfth embodiment.

FIG. 14A is a transverse cross-sectional view of a gas turbine combustor according to a twelfth embodiment of the present invention. In this embodiment, the combustor 5L is divided into six sectors by structural members of a triangular prism-shape each formed by a plate 19L shown in FIG. 14B. Two premixers 1L for supplying a fuel-air premixture, as well as one whirl device 22L for supplying only air, are provided within each triangular prism-shaped structural member, and the premixers 1L and the swirl device 22L are arranged such that their centers are disposed at apexes of a regular triangle, respectively. An outlet of the swirl device 22L is disposed downstream of circulating flows 8 formed at outlets of the premixers 1L. The directions of longitudinal vortexes, discharged respectively from the premixers 1L in each triangular prism-shaped structural member, as well as the intensity of circulations of these vortexes, are the same. The direction of a longitudinal vortex discharged from the swirl device 22L is opposite to the direction of the longitudinal vortexes discharged respectively from the premixers 1L, and the intensity of the circulation of the vortex of the swirl device 22L is a half of the intensity of the longitudinal vortex of the premixer 1L. With this arrangement, the above-mentioned formulas 1 and 2 are satisfied, and the three longitudinal vortexes, discharged respectively from the premixers 1L and the swirl device 22L, can be combined into one longitudinal vortex. The fuel-air premixture supplied from each premixer 1L is burned in the circulating flows 8 formed at its outlet, and flame is cooled downstream of the circulating flows 8 by the combination of the above three longitudinal vortexes, and therefore a high-temperature region where NOx is produced is limited to inside the circulating flows 8, so that the production of NOx can be easily suppressed. Thus, by producing the longitudinal vortex by other means for supplying only air or fuel than a premixer as in this embodiment, NOx can be reduced, and flame can be stabilized.

Figure 15:
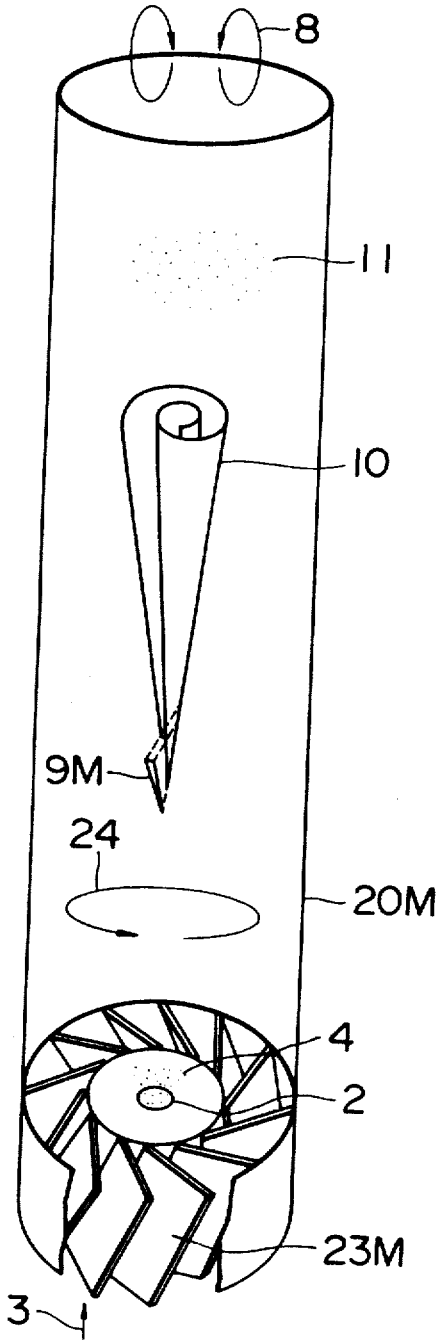
FIG. 15 is a schematic view of a gas turbine combustor according to a thirteenth embodiment of the present invention.

FIG. 15 is a schematic view of a gas turbine combustor according to a thirteenth embodiment of the present invention. A premixer of this embodiment comprises a cylindrical container 20M having a swirl vane member 23M provided at an inlet thereof. Combustion air 3 is supplied from the inlet of the premixer through the swirl vane member 23M, and fuel 4 is injected from a fuel injection nozzle 2 provided at a central portion of the swirl vane member 23M. The swirl vane member 23M forms a swirl flow 24 of the combustion air 3, and mixes this air 3 with fuel 4. A main flow (stream) of the fuel-air premixture, thus formed at the inlet portion of the premixer, shifts from a peripheral direction to an axial direction as it flows downstream. Within the premixer, a Lanchester vortex 10 is formed by a blade-like structural member 9M provided downstream of the position where this main stream shifts to the axial direction. In this case, using the mixing effects by the swirl flow 24 and the Lanchester vortex 10, the uniform fuel-air premixture 11 can be obtained at an outlet portion, and therefore the NOx-reducing effect can be further enhanced. Flame can be stabilized by circulating flows 8 formed at the outlet of the premixer.

Figure 16:
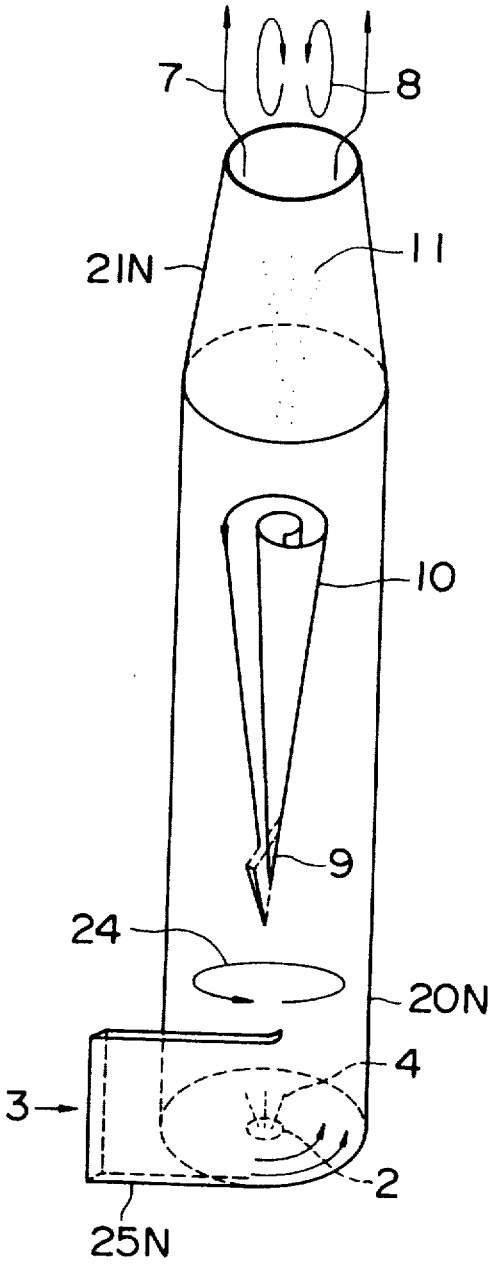
FIG. 16 is a schematic view of a gas turbine combustor according to a fourteenth embodiment of the present invention.

FIG. 16 is a schematic view of a gas turbine combustion according to a fourteenth embodiment of the present invention. A body of a premixer in this embodiment comprises a cylindrical container 20N having a slit portion 25N at its side surface. This cylindrical container 20N has a constricted flow passage 21N at its outlet portion. Combustion air 3 is supplied from the slit portion 25N into the cylindrical container 20N, and fuel 4 is injected from a fuel injection nozzle 2 provided at an inlet of the premixer. The combustion air 3 forms a swirl flow 24 within the cylindrical container 20N, and is mixed with the fuel 4. A main flow (stream) of the fuel-air premixture, thus formed at the inlet portion of the premixer, shifts from a peripheral direction to an axial direction as it flows downstream. Within the premixer, a Lanchester vortex 10 is formed by a blade-like structural member 9 provided downstream of the position where this main stream shifts to the axial direction, and uniformly mixes the fuel-air premixture. Also, the pressure at the peripheral portion of the Lanchester vortex 10 increases at the constricted flow passage 21N while the pressure at the center of this vortex decreases. Therefore, because of a mixing effect achieved by radial flows due to the pressure difference between the center and peripheral portion of this vortex, the uniformity of the fuel-air premixture is further enhanced. Thus, the more uniform premixture 11 can be obtained by these effects, and therefore the production of NOx can be further suppressed. At an outlet of the constricted flow passage 21N, the high-pressure portion (peripheral portion) of the Lanchester vortex 10 is radially expanded, so that the pressure at the center of the vortex increases. Circulating flows 8 are formed by the difference in pressure at the vortex center between the outlet and interior of this constricted flow passage 21N, so that the blowing-out of flame can be prevented. Moreover, the constricted flow passage 21N serves to increase the velocity of axial flow of the peripheral portion of the Lanchester vortex 10, and therefore a main stream 7 of high velocity is formed outside the circulating flows 8 at the outlet, thereby preventing a back fire of flame. Therefore, flame can be further stabilized.

Figure 17:
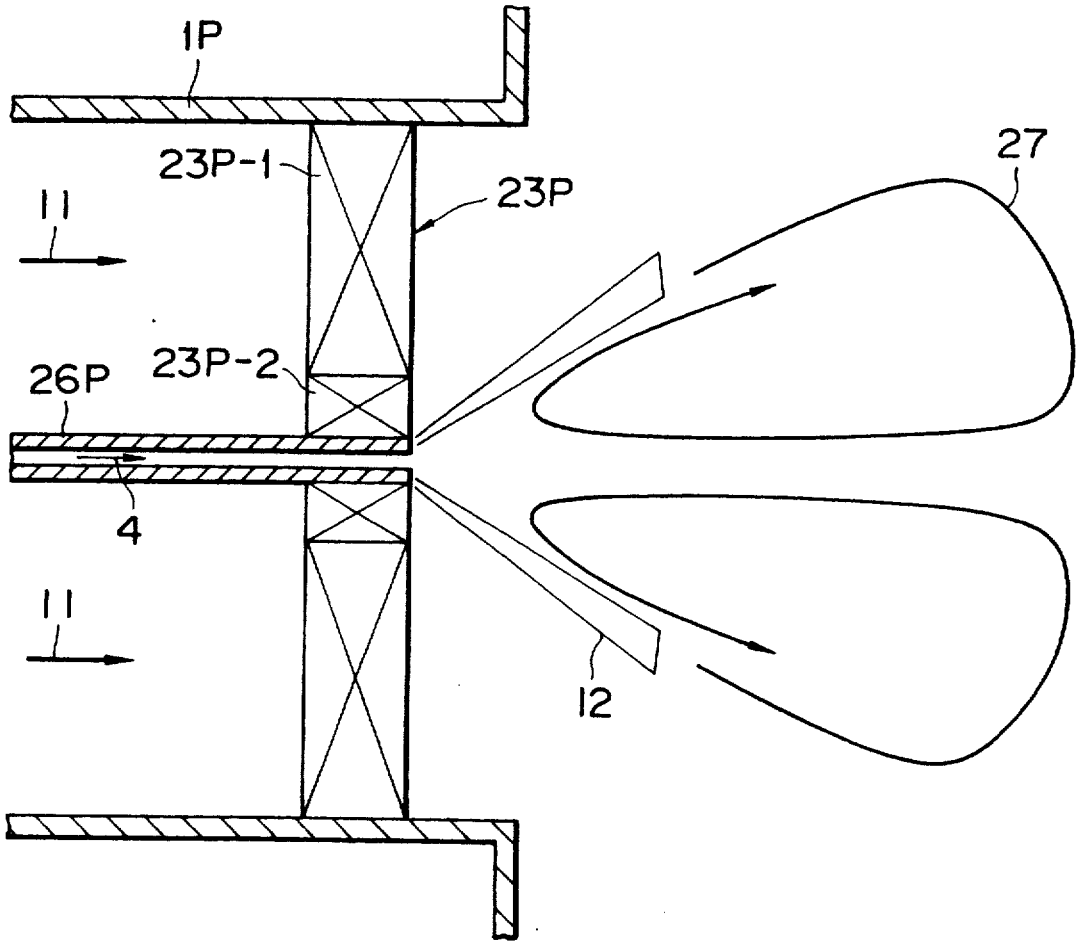
FIG. 17 is a detailed view showing a portion around an outlet of a premixer according to a fifteenth embodiment of the invention.
Figure 18:
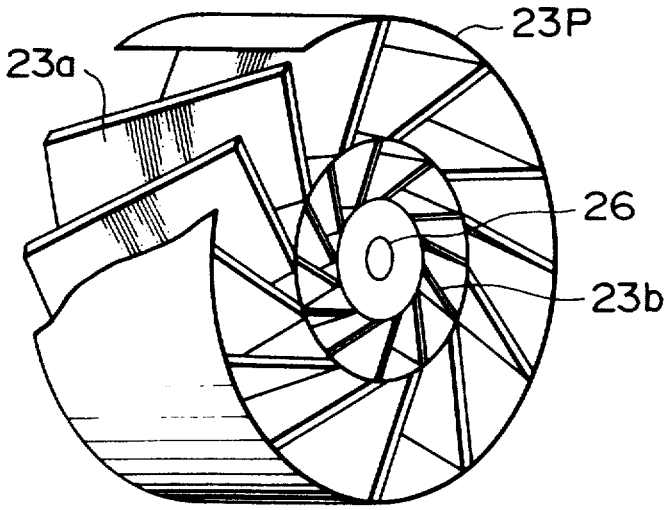
FIG. 18 is a view showing the construction of a blade member in FIG. 17.

FIG. 17 is a longitudinal cross-sectional view showing in detail an outlet portion of a premixer according to a fifteenth embodiment of the present invention. FIG. 18 is a view showing the construction of a swirl vane member in FIG. 17.

In these Figures, the premixer 1P has the swirl vane member 23P (FIG. 18) provided at an outlet portion thereof. The swirl vane member 23P comprises an outer swirl vane member 23P-1 and an inner swirl vane member 23P-2 mounted inside this outer swirl vane member. A fuel pipe 26P, connected at its one end to a fuel system, is connected to a central portion of the swirl vane member 23P. In the premixer 1P, combustion air and fuel, supplied from an inlet thereof, are mixed together through diffusion to form a fuel-air premixture 11 which flows through the premixer 1P, and is discharged to a combustion chamber. At this time, the premixture 11 is swirled in a peripheral direction by the swirl vane member 23P (comprising the outer swirl vane member 23P-1 and the inner swirl vane member 23P-2), provided at the outlet portion of the premixer 1P, to form a swirl flow. Fuel flows from the fuel pipe 26P into the combustion chamber, and reacts with the premixture 11 to be burned, thereby forming a diffusion flame 12. At this time, burnt gas 27 of high temperature is caused by the swirl flow, formed by the swirl vane member 23P (comprising the outer swirl vane member 23P-1 and the inner swirl vane member 23P-2), to form reverse flow regions in the vicinity of a center axis of the diffusion flame 12; however, in this embodiment, a swirl number represented by the ratio of the peripheral momentum of the swirl flow, produced by the inner swirl vane 23P-2, to the axial momentum, that is, the intensity of the swirl represented by the ratio of the peripheral flow velocity to the axial flow velocity, is greater than the intensity of the swirl flow produced by the outer swirl vane member 23P-1. With this arrangement, the reverse flow regions are expanded by the swirl effect of the outer swirl vane member 23P-1, thereby decreasing a stagnant region near to the center axis which stagnant region would create the cause of the blowing-out of flame. Therefore, the circulating flows, produced in the vicinity of the center axis of the diffusion flame 12, can be stabilized, and hence the blowing-out of flame is prevented, thereby enhancing the stability of flame. By thus stabilizing the circulating flows in the vicinity of the center axis, the shaking due to the flickering of flame can also be reduced. Although this embodiment is effective for other constructions than the construction in which fuel is supplied through the fuel pipe 26P for pilot combustion purposes, the stability of flame is better when using the diffusion (pilot) flame in combination, in which case combustion by a lean fuel is possible, and therefore NOx can be reduced.

Figure 19:
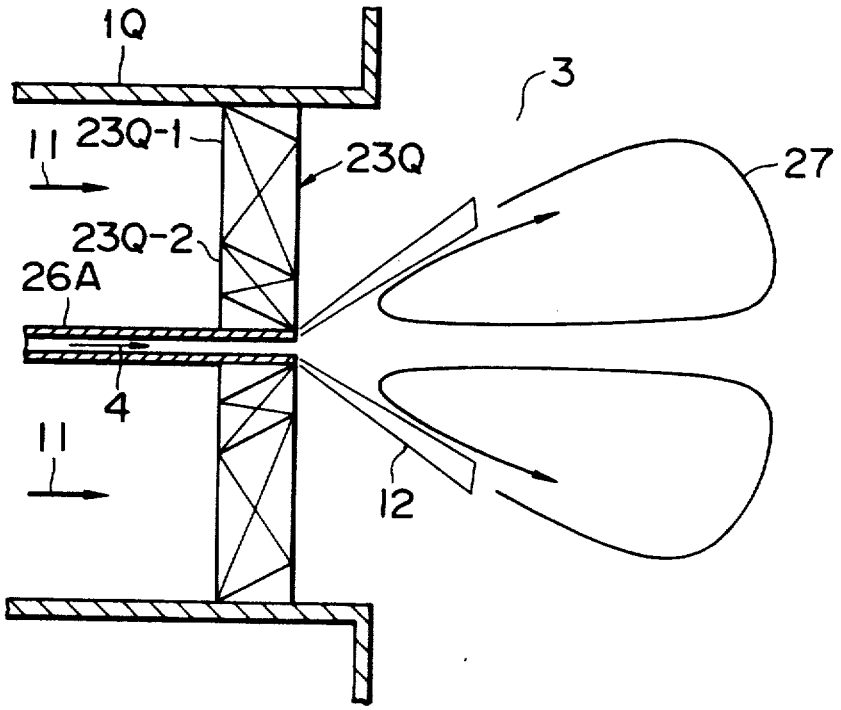
FIG. 19 is a detailed view showing a portion around an outlet of a premixer according to a sixteenth embodiment of the present invention.

FIG. 19 is a cross-sectional view showing an outlet portion of a premixer according to a sixteenth embodiment of the present invention. A premixer 1Q in this embodiment differs from the premixer of the fifteenth embodiment of FIG. 17 in that a swirl vane member 23Q (comprising an outer swirl vane member 23Q-1 and an inner swirl vane member 23Q-2) provided on a center axis of a combustor is tapered. With this construction, reverse flow regions formed in the vicinity of the center axis are localized. With this arrangement, the length of the flame can be reduced, so that the combustor of a compact construction can be achieved. Moreover, when the intensity of the swirl is increased, the diffusion flame 12 is radially spread under the influence of centrifugal force of the swirl flow, so that the combustion of the fuel-air premixture at an outer peripheral portion of the swirl flow is promoted. As a result, the amount of unburnt fuel, as well as the amount of exhaust of carbon monoxide, can be reduced. Furthermore, when the intensity of the swirl in the vicinity of the center axis is increased, a pressure loss is higher in the vicinity of the center axis than at the outer peripheral portion, thereby decreasing the flow rate, so that the flow velocity in the vicinity of the diffusion flame is lowered, thereby stabilizing the flame. Incidentally, by increasing the angle of the swirl vane member with respect to the swirl axis, the effects of this embodiment can be achieved; however, if the swirl vane member of a tapering construction is provided as in this embodiment, the intensity of the swirl can be increased even downstream of the whirl flow.

Figure 20:
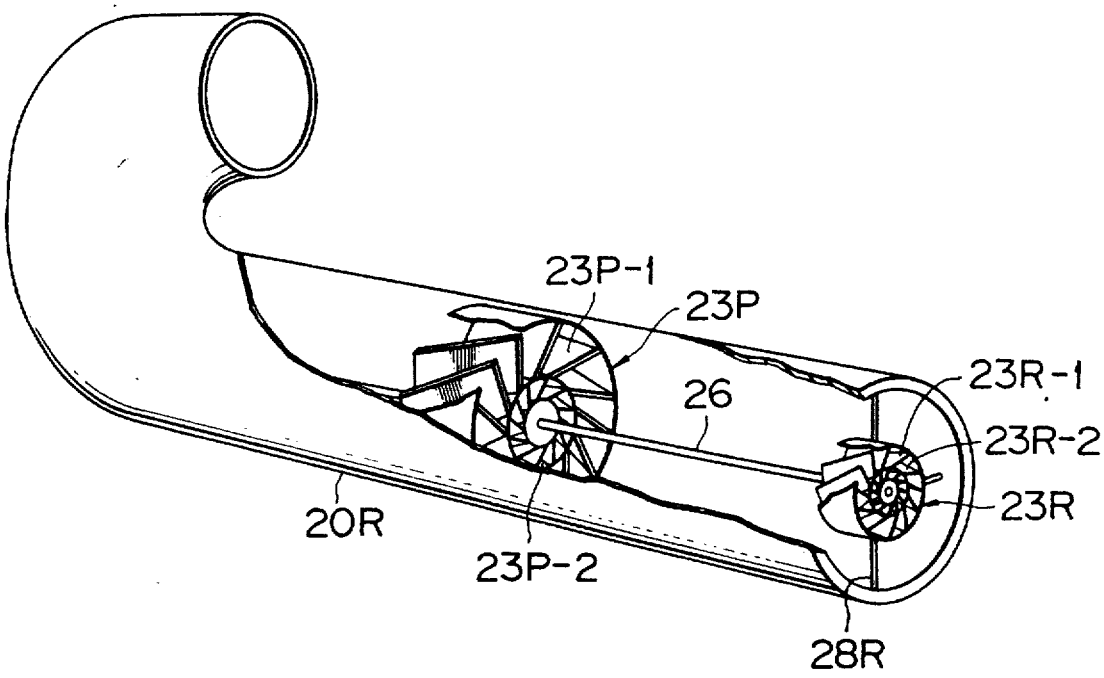
FIG. 20 is a schematic view of a gas turbine combustor according to a seventeenth embodiment of the present invention.

FIG. 20 is a schematic view of a gas turbine combustor according to a seventeenth embodiment of the present invention. A premixer of this embodiment comprises a cylindrical container 20R within which a first swirl vane member 23P (comprising an outer swirl vane member 23P-1 and an inner swirl vane member 23P-2) shown in FIG. 18 is provided, and a second swirl vane member 23R (comprising an outer swirl vane member 23R-1 and an inner swirl vane member 23R-2) is supported at an outlet portion of the cylindrical container 20R by a support bar 28R. The second swirl vane member 23R is supported in spaced relation to an inner peripheral surface of the cylindrical container 20R. Combustion air, supplied from an inlet of the premixer, and fuel, injected from a fuel injection nozzle, are mixed together by the first swirl vane member 23P mounted within the premixer, and flow downstream through the premixer. Then, the second swirl vane member 23R, supported at the outlet portion by the support bar 28R, imparts a swirling motion to this premixture. In this embodiment, the intensity of the swirl in the vicinity of the center of the swirl flow can be increased by the second swirl vane member 23R, and therefore a similar effect as in the above embodiment can be obtained. In this embodiment, since a swirl flow is also formed within the premixer, the mixing of the combustion air with fuel is promoted, and the production of any localized high-temperature region of flame due to spatial unevenness is prevented, so that NOx can be reduced. Furthermore, in this embodiment, even if flame spreads within the premixer as a result of back fire, an increased pressure within the premixer can be easily relieved, and therefore excellent safety is obtained.

Instead of the first swirl vane member 23P of this embodiment, a premixer inlet of a rectangular shape is formed in tangential relation to a side wall of the premixer. The thus formed premixer inlet is disposed in eccentric relation to the center axis of the premixer, and therefore combustion air, supplied into the premixer, is formed into a whirl flow, and is mixed with fuel, injected from a fuel injection nozzle (not shown), to form a fuel-air premixture. The swirl vane member 23R, supported at the outlet portion of the premixer by the support bar 28R, imparts a swirling motion to the premixture, thereby increasing the intensity of the swirl in the vicinity of the center of the swirl flow, so that a similar effect as described above can be obtained.

Figure 21:
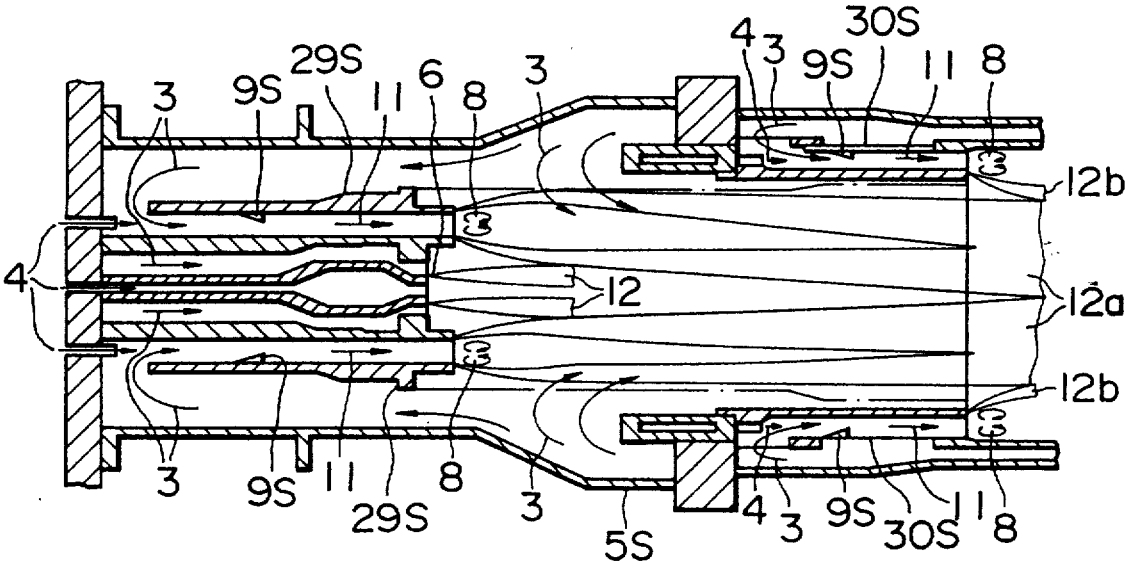
FIG. 21 is a longitudinal cross-sectional view showing a gas turbine combustor according to an eighteenth embodiment of the present invention.

FIG. 21 is a longitudinal cross-sectional view of a gas turbine combustor according to an eighteenth embodiment of the present invention. This embodiment is directed to the combustor of the two-stage premix type. The combustor 5S comprises a plurality of first-stage premixers 29S provided around a pilot burner 6 provided at its center, and a plurality of second-stage premixers 30S disposed downstream of the first-stage premixers 29S. Combustion air 3 and fuel 4 are injected respectively from nozzles of the pilot burner 6 to form a diffusion flame 12. Each first-stage premixer 29S mixes combustion air 3 and fuel 4 by the use of a longitudinal vortex formed by a blade-like structural member 9S, thereby forming a fuel-air premixture 11, and circulating flows 8 are formed at an outlet thereof. As described above, because of the effect of the longitudinal vortex, the premixture 11 is mixed spatially uniformly, and therefore any localized high-temperature region due to the unevenness of the concentration will not be produced in a premixture flame **12*a*, so that NOx can be reduced, and also because of the effect of the circulating flows 8, the premixture flame 12*a* can be stabilized. By arranging the first-stage premixers 29S in such a manner that the directions of rotation of the longitudinal vortexes, produced respectively by any two adjacent ones of the first-stage premixers 29S, are opposite to each other as in the embodiment of FIG. 11, propagation of the diffusion flame 12 to the premixture flame 12*a* is enhanced, and the premixture flame 12*a* can be stabilized. In this embodiment, each second-stage premixer 30S, like the first-stage premixer 29S, mixes combustion air 3 and fuel 4 by the use of a longitudinal vortex formed by a blade-like structural member 9S, thereby forming a fuel-air premixture 11, and circulating flows 8 are formed at an outlet thereof. The premixture flame 12*a*, formed at the outlet of the first-stage premixer 29S diffuses downstream, and shifts to the fuel-air premixture at the outlet of the second-stage premixer 30S, thereby producing a premixture flame 12*b*. Here, because of the effect of the circulating flows 8, the premixture flame 12*b* can be stabilized. Therefore, by combining the effect of the longitudinal vortexes, produced by the first-stage premixers 29S, with the effect of the longitudinal vortexes produced by the second-stage premixers 30S, the reduction of NOx and the stabilization of flame in the combustor 5S can be achieved. In this embodiment, a flow rate of the fuel-air premixture required for the combustor 5S can be suitably distributed to the first-stage premixers 29S and the second-stage premixers 30S, and by doing so, the premixture can be burned in a very lean condition, so that the NOx-reducing effect can be enhanced. Moreover, a part of air 3 is supplied from the upstream side of the second premixer 30S to the region where the premixture flame 12*a* is produced, so that the structural members within the combustor are cooled to be prevented from burning, and also the premixture flame 12*a*** is cooled, thereby further enhancing the NOx-reducing effect.

Next, a method of operating the gas turbine combustor of this embodiment will now be described. When the combustor 5S is to be activated, the pilot burner 6 is first activated, and a flow rate of air 3 and a flow rate of fuel 4 supplied to this pilot burner are gradually increased, thereby increasing a diffusion combustion output. Then, at the time when the output reaches a first predetermined proportion of the rated output, the first-stage premixers 29S are activated, and a flow rate of the fuel-air premixture 11 supplied thereto is increased, thereby increasing a first premixture combustion output. At this time, a flow rate of air 3 and a flow rate of fuel 4 supplied to the pilot burner 6 are reduced to decrease the ratio of the diffusion combustion output to the premixture combustion output, thereby reducing the amount of production of NOx to a low level. When the output reaches a second predetermined proportion of the rated output, a flow rate of air 3 and a flow rate of fuel 4 supplied to the first-stage premixers 29S, as well as a flow rate of air 3 and a flow rate of fuel 4 supplied to the pilot burner 6, are kept constant, and the second-stage premixers 30S are activated, and a flow rate of the premixture 11 supplied thereto is increased, thereby increasing a second-stage premixture combustion output. At the time when the output reaches the rated level, a flow rate of air 3 and a flow rate of fuel 4 supplied to the second-stage premixers 30S are kept constant, and the combustor 5S is operated at its rated output. When the combustor 5 is to be stopped, an operation reverse to the activating operation is carried out. By suitably determining the above-mentioned first and second predetermined proportions, the low NOx characteristics of the premixture flame can be efficiently utilized while compensating for the instability of the premixture flame in the low-output condition by the stability of the diffusion flame. Therefore, the combustor can be operated at a low NOx-production rate with an excellent flame stability. By controlling the output increase of the plurality of first-stage premixers 29S and the plurality of second-stage premixers 30S in a stepwise manner, the combustor can carry out a substantially continuous load operation.

Figure 22:
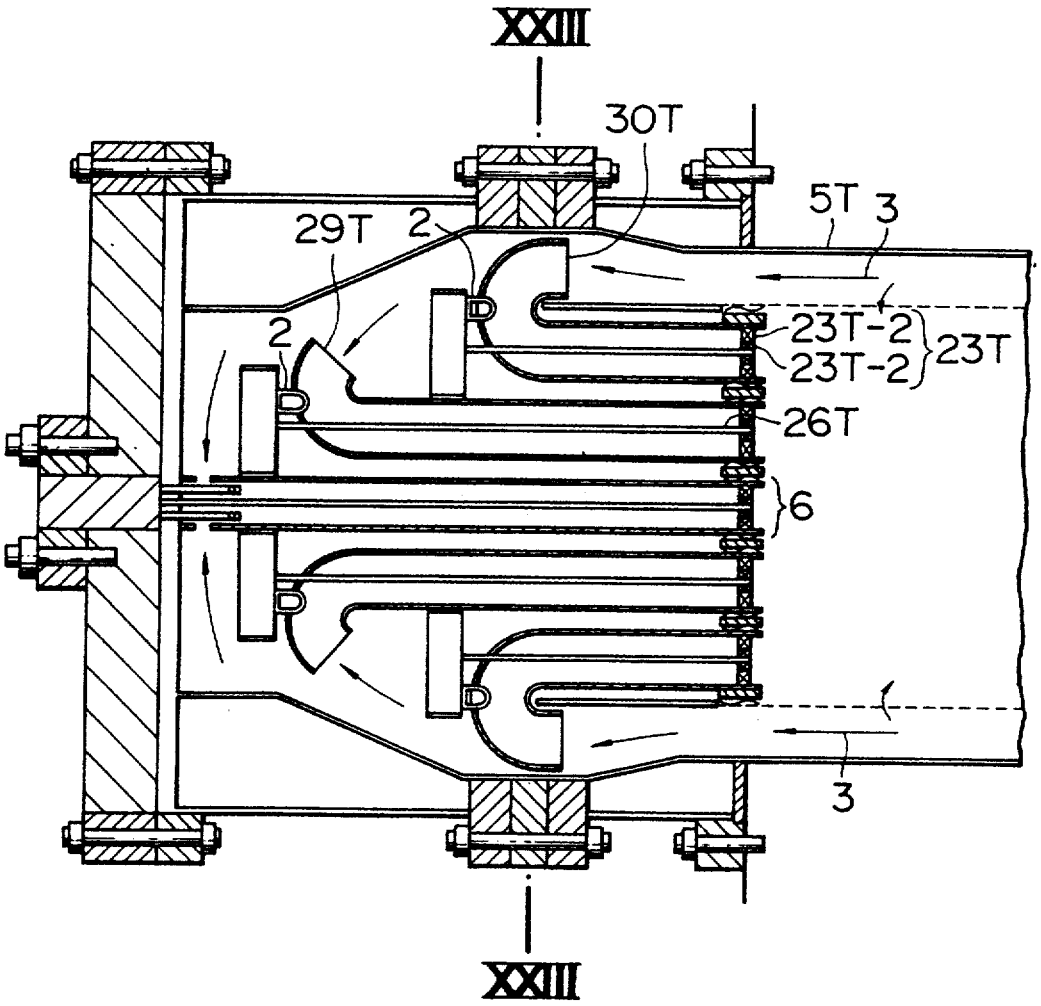
FIG. 22 is a longitudinal cross-sectional view showing a gas turbine combustor according to a nineteenth embodiment of the present invention.
Figure 23:
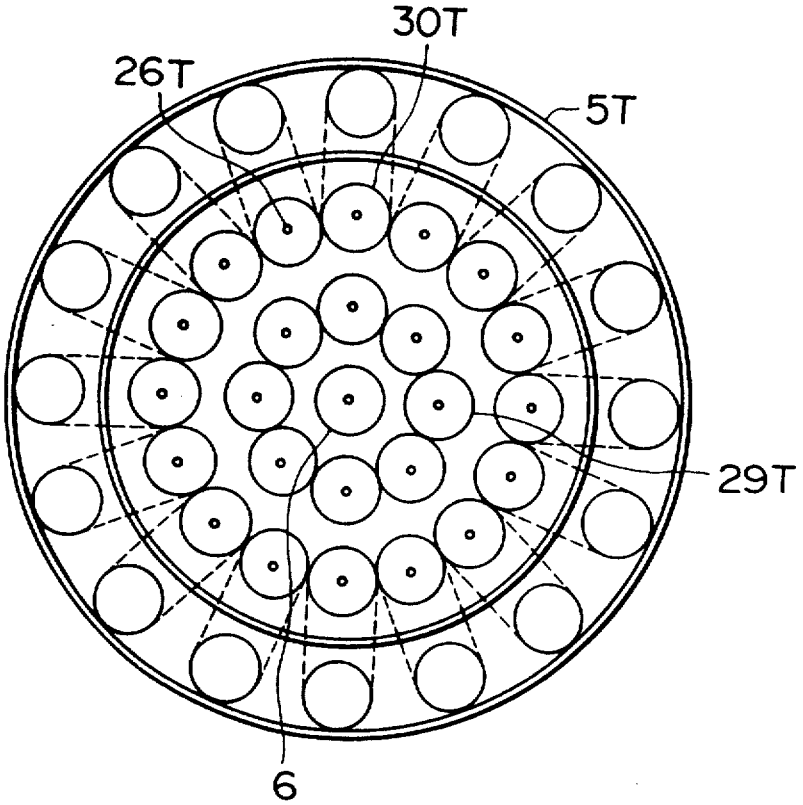
FIG. 23 is a cross-sectional view taken along the line XXIII—XXIII of FIG. 22.

FIG. 22 is a longitudinal cross-sectional view of a gas turbine combustor according to a nineteenth embodiment of the present invention. FIG. 23 is a cross-sectional view taken along the line XXIII—XXIII of FIG. 22. This embodiment is directed to the combustor of the two-stage premix type. The combustor 5T comprises a plurality of first-stage premixers 29T provided around a pilot burner 6 provided at its center, and a plurality of second-stage premixers 30T provided around the plurality of first-stage premixers 29T. In this embodiment, each of the pilot burner 6, the first-stage premixer 29T and the second-stage premixer 30T has a swirl vane member 23T provided at its outlet portion, the swirl vane member 23T comprising an outer swirl vane member 23T-1 and an inner swirl vane member 23T-2 mounted inside this outer swirl vane member. The swirl vane member 23T imparts a swirling motion to a fuel-air premixture, thereby forming a swirl flow. At this time, a swirl number represented by the ratio of the peripheral momentum of the swirl flow, produced by the inner rotary blade 23T-2, to the axial momentum, that is, the intensity of the swirl represented by the ratio of the peripheral flow velocity to the axial flow velocity, is greater than the intensity of the swirl flow produced by the outer swirl vane member 23T-1. Therefore, the reverse flow regions, formed by the high-temperature burnt gas, are expanded by the swirl effect of the outer swirl vane member 23T-1, thereby decreasing a stagnant region near to the center axis which stagnant region would create the cause of the blowing-out of flame. Therefore, the circulating flows, produced in the vicinity of the center axis of a diffusion flame 12, can be stabilized, and hence the blowing-out of flame is prevented, thereby enhancing the stability of flame. The swirl vane member in this embodiment can be applied not only to the combustor of FIG. 22 in which the premixture of fuel and the air is formed, and fuel is injected at the outlet, and is burned together with the premixture, but also to various types of combustors, such as a combustor in which a premixture of fuel and air is formed, and this premixture is burned, and a combustor in which fuel and air are injected separately to achieve combustion.

In this embodiment, with respect to start-up and suspension of the gas turbine combustor, by operating the pilot burner 6, the plurality of first-stage premixers 29T and the plurality of second-stage premixers 30T in this sequence according to the same operation method as in the preceding embodiment, the combustor can be operated while achieving the same effects as in the preceding embodiment, that is, the low NOx-producing effect and the excellent flame stability. Furthermore, by controlling the output increase of the plurality of first-stage premixers 29T and the plurality of the second-stage premixers 30T in a stepwise manner, the combustor can effect a substantially continuous load operation.

Figure 24:
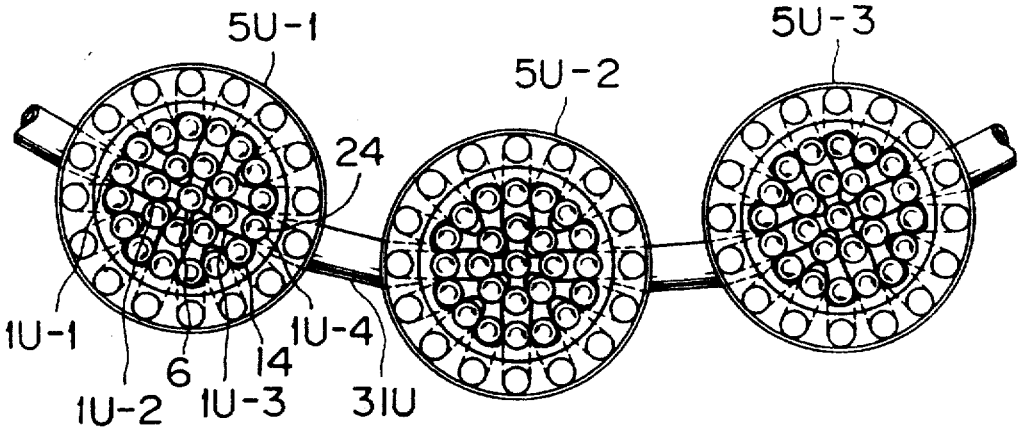
FIG. 24 is a cross-sectional view showing a gas turbine combustor according to a twentieth embodiment of the present invention which comprises a plurality of combustors.

FIG. 24 is a cross-sectional view of a twentieth embodiment of a gas turbine combustors of the present invention which is constituted by a plurality of combustors. In this Figure, the plurality of combustors 5V-1, 5V-2 and 5V-3 are connected together by flame propagation pipes 31V to provide a combustor group. In each of these combustors, the direction of swirling of swirl flows 24, produced respectively by those premixers disposed on a common line on which the flame propagation pipe 31V lie, for example, premixers 1V-1, 1V-2, 1V-3 and 1V-4 of the combustor 5V-1 (which are disposed on the above common line together with a pilot burner 6), are the same. The premixers in each combustor are also arranged such that the directions of swirling of the swirl flows 24 produced respectively by any two adjacent ones of the premixers disposed respectively in adjacent concentric circles are opposite to each other. In the combustor of this embodiment having the premixers so arranged, the swirl flows produced by the premixers induce flows 14 (of a generally heart-shape) at four regions symmetrical with respect to the center of the combustor, as shown in FIG. 24. As a result, a diffusion flame formed by the pilot burner 6 is conveyed by the flows 14 to the premixers disposed at the outer peripheral portion, thereby burning an unburnt fuel-air premixture. A premixture flame is conveyed from the premixer 1V-4 to the premixer of the adjacent combustor 5V-2 through the flame propagation pipe 31, thereby burning an unburnt fuel-air premixture. In this case, flows 14 formed by the swirl flows 24 convey a premixture flame to the central portion of the combustor. The fuel-air premixture, supplied from each of the premixers, is burned while stabilizing flame by circulating flows formed at its outlet, and therefore the premixture flame is stabilized. In this embodiment, propagation from the diffusion flame to the premixers is enhanced, and also propagation of the flame to the other combustors can be achieved. And besides, NOx can be reduced.

Figure 25:
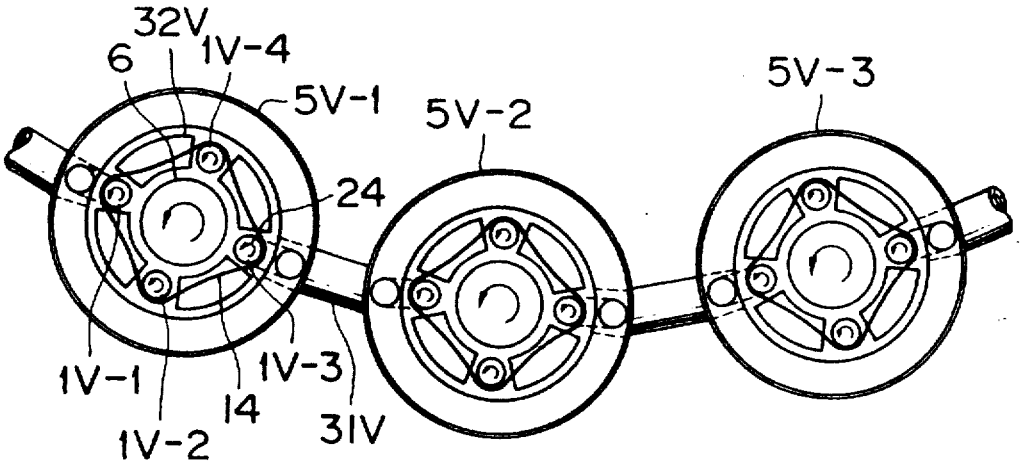
FIG. 25 is a cross-sectional view showing a gas turbine combustor according to a twenty-first embodiment of the present invention which comprises a plurality of combustors.

FIG. 25 is a cross-sectional view of a twenty-first embodiment of a gas turbine combustor of the present invention constituted by a plurality of combustors. In this Figure, the plurality of combustors 5V-1, 5V-2 and 5V-3 are connected together by flame propagation pipes 31V to provide a combustor group. In each of the combustors, the directions of swirling of swirl flows 24, produced respectively by a pilot burner 6 and premixers 1V-1, 1V-2, 1V-3 and 1V-4, are the same, and these are arranged in an annular manner. A premixer 32 of a modified sector-shape is provided between any two adjacent ones of the premixers 1V-1 to 1V-4. In the combustor of this embodiment having the premixers so arranged, the swirl flows, produced by the premixers 1V-1, 1V-2, 1V-3 and 1V-4, and premixtures, produced by the sector-shaped premixers 32, induce a flow 14 (of a generally square shape) as shown in FIG. 25. As a result, as in the preceding embodiment, a diffusion flame formed by the pilot burner 6 is conveyed by the flow 14 to the premixers 1V-1, 1V-2, 1V-3 and 1V-4 and the sector-shaped premixers 32 disposed at the outer peripheral portion, thereby burning an unburnt fuel-air premixture. A premixture flame is conveyed from the premixer 1V-4 to the premixer of the adjacent combustor 5V-2 through the flame propagation pipe 31, thereby burning an unburnt fuel-air premixture. In this embodiment, propagation from the diffusion flame to the premixers is further enhanced.

Figure 26:
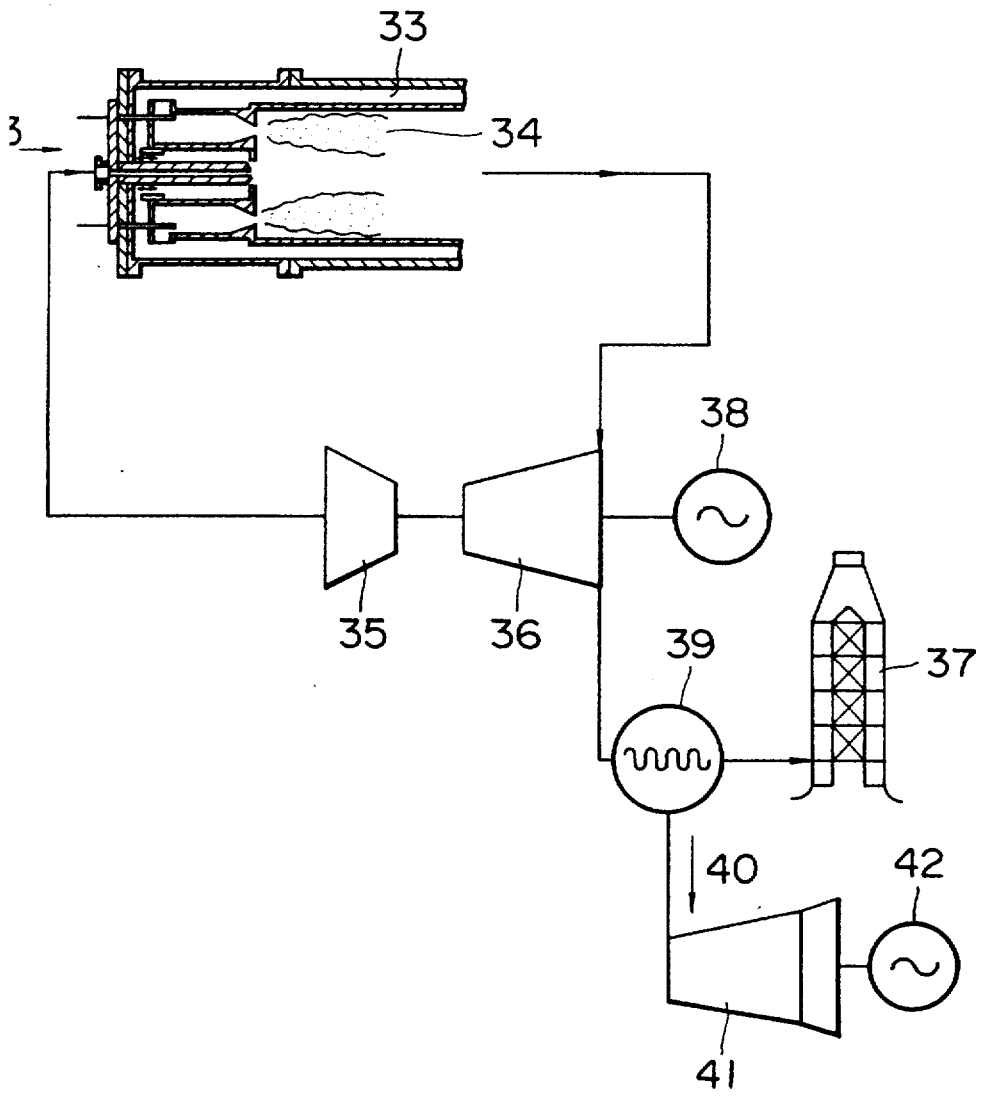
FIG. 26 is an illustration showing a power generation system using a combustor of the present invention.

FIG. 26 shows a power generation system using any one of the above-mentioned combustors of the present invention. In this embodiment, high-temperature combustion gas 34, produced in a combustor 33, is supplied to a gas turbine 36 to drive the same. Part of power, produced by the combustion gas 34 in the gas turbine 36, is used for driving an air compressor 35, and the remainder is used for driving a generator 38. The air compressor 35 produces combustion air 3, and feeds it to the combustor 33. The combustion gas 34, after driving the gas turbine 36, produces steam 40 when passing through an exhaust heat recovery boiler 39, and is discharged to the ambient atmosphere through a chimney 37. The steam 40, produced in the exhaust heat recovery boiler 39, is fed to a steam turbine 41, and drives a generator 42. By using any one of the above-mentioned combustors as the combustor 33, combustion can be stably effected while keeping an amount of NOx produced to a low level, and the power generation system of a high efficiency can be provided.

This embodiment is not limited to the above power generation system, and the invention can be applied, for example, to a gas turbine engine in which hot combustion gas 34, produced in the combustor 33, is supplied to the gas turbine 36 to drive the same, or a gas turbine power generation system in which hot combustion gas 34 produced in the combustor 33 is supplied to the gas turbine 36 to drive the same to drive the generator 38.

In the present invention, air and fuel can be uniformly mixed together, utilizing the vigorous mixing effect of the vortex produced in the premixer, and therefore there can be provided the combustor of a small size having a low NOx-producing rate, and also there can be provided the method of operating the combustor.

Moreover, the premixture flame can be stabilized by the effect of the circulating flows formed at the outlet of the premixer by the longitudinal vortex.

Furthermore, by providing a plurality of premixers of a small size and by operating these premixers in a stepwise manner, a gas turbine combustor capable of effecting a continuous load operation, as well as a method of operating the same, can be provided.

By providing an arrangement in which a plurality of combustors are interconnected by the flame propagation pipes at their outer peripheral portions disposed on a straight line on which some of the premixers are disposed together with the pilot burner, and in which the directions of swirling of swirl flows, discharged respectively from these premixers, are generally the same, there can be provided the gas turbine combustor excellent in the flame propagating property.

What is claimed is:

1. A combustor having a premixer for mixing air and fuel together to form a premixture, comprising:

a structural member, having an angle of elevation with respect to a direction of a main stream of said premixture, provided within said premixer, said structural member being shaped as a triangular pyramid and having a portion projecting from an inner surface of said premixer.

2. A gas turbine combustor having premixers, each for mixing air and fuel together to form a premixture, wherein said premixture is burned to produce combustion gas, the combustor comprising:

a pilot burner for injecting air and fuel separately to effect diffusion combustion provided at a center portion of said combustor; a plurality of said premixers peripherally arranged in a surrounding relation to said pilot burner; and each of said premixers containing a structural member, being shaped as a triangular pyramid, for producing a vortex having an axis of rotation thereof extending in a direction of a main stream of said premixture.

3. A combustor comprising a premixer for mixing air and fuel together to form a premixture;

wherein said premixer produces a premixture combustion flame, and contains a structural member, being shaped as a triangular pyramid, for producing a vortex having an axis of rotation thereof extending in a direction of a main stream of said premixture; and a diffusion combustion flame is produced upstream of said premixture combustion flame.

4. A method of operating a combustor for burning a premixture of air and fuel comprising the steps of:

mixing said premixture using a vortex having an axis of rotation thereof extending in a direction of a main stream of said premixture and being formed by using a structural member shaped as a triangular pyramid, and burning said premixture.

5. A method according to claim 4, in which a plurality of said vortexes are used, and the directions of rotation of any two adjacent ones of said vortexes are opposite to each other.

6. A method of operating a gas turbine combustor for burning a premixture obtained by mixing air and fuel together comprising the steps of:

separately injecting air and fuel to effect a diffusion combustion, mixing said premixture using a vortex having an axis of rotation thereof extending in a direction of a main stream of said premixture and being formed by using a structural member shaped as a triangular pyramid, and burning said premixture to effect a premixture combustion.

7. A method of operating a gas turbine combustor for burning a premixture obtained by mixing air and fuel together comprising:

a first step of injecting air and fuel separately to effect a diffusion combustion; and a second step of mixing said diffusion combustion and said premixture together, using a vortex having an axis of rotation thereof extending in a direction of a main stream and being formed by using a structural member shaped as a triangular pyramid, thereby effecting a premixture combustion.

8. A combustor comprising:

a premixer for mixing air and fuel together to form a premixture;

a structural member fixedly secured to an inner surface of said premixer, having an angle of elevation with respect to a direction of a main stream of said premixture, said structural member being shaped as a triangular pyramid and having a triangular cross-section such that an area of the triangular cross-section gradually increases along the direction away from a point where the structural member is fixedly secured to said premixer.

9. A combustor comprising:

a premixer for mixing air and fuel together to form a premixture, the premixer having an average inner diameter as calculated along planes perpendicular to a main stream of said premixture;

a structural member secured to an inner surface of said premixer, the structural member being shaped as a triangular pyramid and having a height as calculated from the inner surface of said premixer, along a plane perpendicular to the main stream, being within a range of 30–50% of the average inner diameter of the premixer.

10. A combustor comprising:

a premixer for mixing air and fuel together to form a premixture;

a structural member fixedly secured to an inner surface of said premixer, having an angle of elevation in a range of 10°–20° with respect to a direction of a main stream of said premixture, said structural member being shaped as a triangular pyramid.

11. A combustor according to claim 10, wherein said structural member has a triangular cross-section such that an area of the triangular cross-section gradually increases along the direction away from a point where the structural member is fixedly secured to said premixer.

12. A combustor according to claim 11, wherein the premixer has an average inner diameter as calculated along planes perpendicular to a main stream of said premixture; and wherein said structural member has a height as calculated from the inner surface of said premixer, along a plane perpendicular to the main stream, being within a range of 30–50% of the average inner diameter of the premixer.

* * * * *

UNITED STATES PATENT AND TRADEMARK OFFICE

CERTIFICATE OF CORRECTION

PATENT NO. : 5,623,826

DATED : April 29, 1997

INVENTOR(S) : Ohtsuka et al.

It is certified that error appears in the above-identified patent and that said Letters Patent is hereby corrected as shown below:

IN THE DRAWINGS:

Delete the title page and replace with the

The drawings Sheets 1 of 3 through 3 of 3, consisting of Figs. 1 - 4, should be deleted and replaced with the attached sheets.

Signed and Sealed this

Third Day of March, 1998

*Attest:*

Bruce Lehman

BRUCE LEHMAN

*Attesting Officer*

*Commissioner of Patents and Trademarks*

United States Patent [19]

Ohtsuka et al.

[11] Patent Number: 5,623,826

[45] Date of Patent: Apr. 29, 1997

[54] COMBUSTOR HAVING A PREMIX CHAMBER WITH A BLADE-LIKE STRUCTURAL MEMBER AND METHOD OF OPERATING THE COMBUSTOR

[75] Inventors: Masaya Ohtsuka; Shin-ichi Inage, both of Hitachi, Japan

[73] Assignee: Hitachi, Ltd., Tokyo, Japan

[21] Appl. No.: 281,099

[22] Filed: Jul. 27, 1994

[30] Foreign Application Priority Data

Jul. 30, 1993 [JP] Japan ..... 5-189882

[51] Int. Cl.[6] ..... F23K 3/00

[52] U.S. Cl. ..... 60/737; 60/747; 60/748

[58] Field of Search ..... 60/737, 738, 746, 60/747, 748, 39.37

[56] References Cited

U.S. PATENT DOCUMENTS

| | | | |
|---|---|---|---|
| 2,558,816 | 7/1951 | Bruynes | 138/37 |
| 2,607,191 | 8/1952 | Lee | 60/35.6 |
| 5,121,597 | 6/1992 | Urushidani et al. | 60/747 |
| 5,239,831 | 8/1993 | Kuroda et al. | 60/737 |
| 5,361,586 | 11/1994 | McWhirter et al. | 60/737 |

FOREIGN PATENT DOCUMENTS

| | | |
|---|---|---|
| 1-203809 | 8/1989 | Japan . |
| 2-275221 | 11/1990 | Japan . |
| 4-103906 | 4/1992 | Japan . |

*Primary Examiner*—Charles G. Freay

*Attorney, Agent, or Firm*—Fay, Sharpe, Beall, Fagan, Minnich & McKee

[57] ABSTRACT

A combustor includes a pilot burner provided at a center portion thereof, and a premixer surrounding the pilot burner. The premixer has a plurality of premix chambers separated from one another in a peripheral direction. Each of the premix chambers includes a fuel injection nozzle provided at an inlet portion thereof, and a blade-like structural member disposed downstream of the fuel injection nozzle. Fuel and air, supplied from an inlet of the premixer, jointly form a premixture, and a Lanchester vortex is formed rearwardly of the blade-like structural member. The Lanchester vortex forms circulating flows at the outlet of the premixer, and also forms a main stream outside these circulating flows.

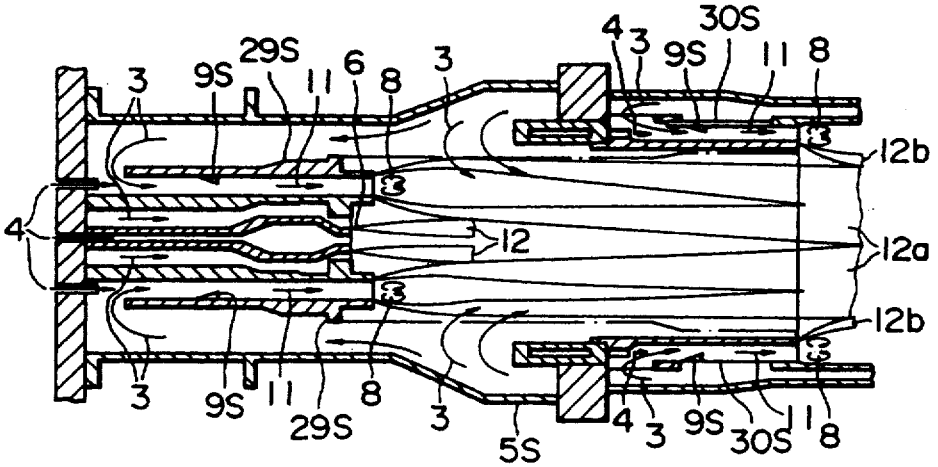

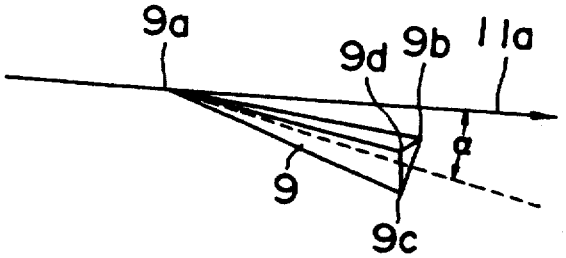

12 Claims, 3 Drawing Sheets